US007756429B2

(12) United States Patent
Inoue

(10) Patent No.: US 7,756,429 B2
(45) Date of Patent: Jul. 13, 2010

(54) IMAGE FORMING APPARATUS HAVING A TRANSPORTING UNIT, A DETECTOR AND A VOLTAGE CONTROLLER

(75) Inventor: Hiroyuki Inoue, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/860,103

(22) Filed: Sep. 24, 2007

(65) Prior Publication Data

US 2008/0080881 A1 Apr. 3, 2008

(30) Foreign Application Priority Data

Sep. 28, 2006 (JP) ..... 2006-264238

(51) Int. Cl.
*G03G 15/00* (2006.01)

(52) U.S. Cl. ..... 399/49

(58) Field of Classification Search ..... 399/43, 399/49, 46, 50, 53, 55, 85
See application file for complete search history.

(56) References Cited

U.S. PATENT DOCUMENTS

| | | | | |
|---|---|---|---|---|
| 7,151,902 | B2 * | 12/2006 | Rakov et al. | 399/66 |
| 2002/0037175 | A1 * | 3/2002 | Nakazato et al. | 399/49 |
| 2004/0165899 | A1 | 8/2004 | Chigira | |
| 2004/0208661 | A1 * | 10/2004 | Kitagawa et al. | 399/49 |

FOREIGN PATENT DOCUMENTS

| | | | |
|---|---|---|---|
| JP | 2003-15369 | A | 1/2003 |
| JP | 2004-198805 | A | 7/2004 |
| JP | 2004-258281 | A | 9/2004 |
| JP | 2005-148355 | A | 6/2005 |
| JP | 2006-071802 | A | 3/2006 |
| JP | 2006078889 | A | 3/2006 |
| JP | 2006251508 | A | 9/2006 |

OTHER PUBLICATIONS

Office Action issued Aug. 11, 2009 for counterpart Japanese Patent Application No. 2006-264238.

* cited by examiner

*Primary Examiner*—Quana M Grainger
(74) *Attorney, Agent, or Firm*—Panitch Schwarze Belisario & Nadel LLP

(57) ABSTRACT

An image forming apparatus includes at least one image forming section, which includes an image bearing body, a charging unit that charges an area on a surface of the image-bearing body, and a developing unit that supplies a developer material to the charged area to form a developer image on the image bearing body. The developer image is transferred from the image-bearing body onto a transporting unit. A detector detects a density of the developer image on the transporting unit. The controller performs a charging voltage correcting operation in which the controller provides a test charging voltage to the charging unit for forming the developer image, and then a normal charging voltage for normal printing is determined based on the density. The controller also performs a developer-supplying voltage correcting operation in which a developer-supplying voltage supplied to a developer supplying unit is determined based on the density.

18 Claims, 28 Drawing Sheets

| CH VOLTAGE WHEN POOR CONDITION OCCURS (VOLTS) | CORRECTED CH VOLTAGE (VOLTS) |
|---|---|
| FIRST CH VOLTAGE (Va) | (FIRST CH VOLTAGE)−100 |
| SECOND CH VOLTAGE (Vb) | (SECOND CH VOLTAGE)−100 |
| THIRD CH VOLTAGE (Vc) | (THIRD CH VOLTAGE)−100 |
| FOURTH CH VOLTAGE (Vd) | (FOURTH CH VOLTAGE)−100 |
| FIFTH CH VOLTAGE (Ve) | (FIFTH CH VOLTAGE)−100 |
| NO POOR CONDITION OCCURS | (THIRD CH VOLTAGE)+50 |

(FIRST TO FIFTH CH VOLTAGES ARE NEGATIVE VOLTAGES)

FIG.12

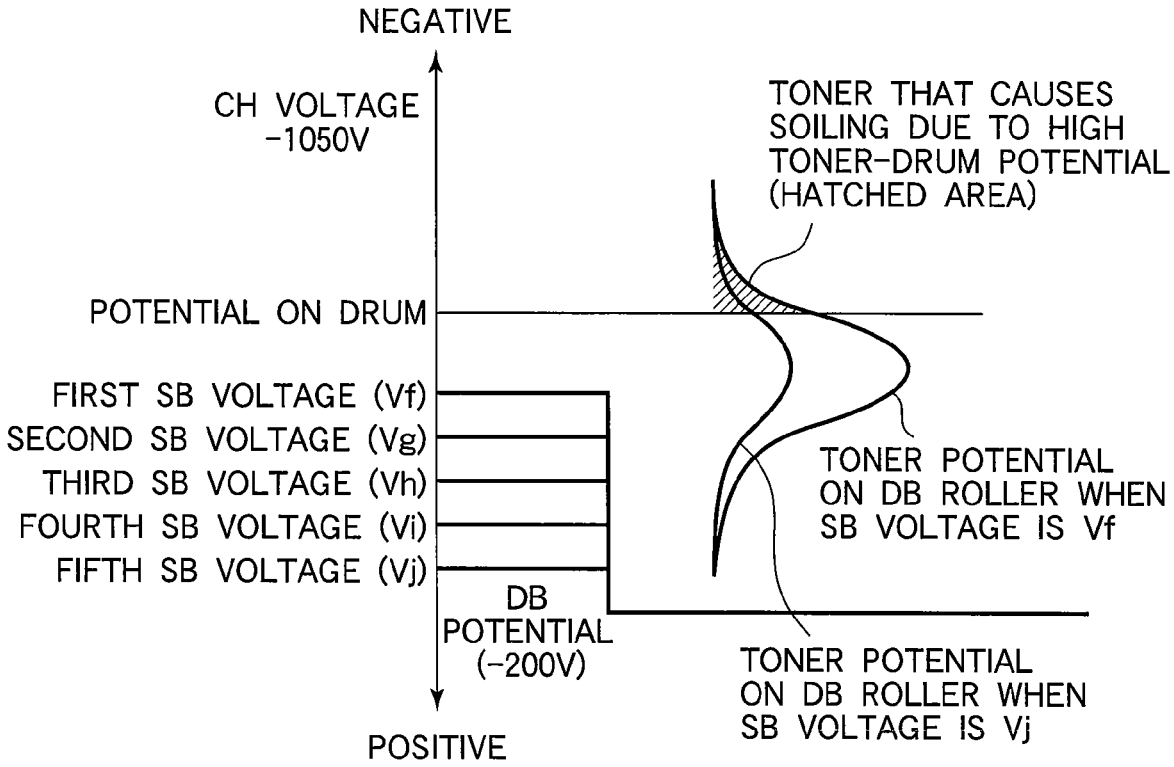

FIG.13

| CH VOLTAGE WHEN POOR CONDITION OCCURS (VOLTS) | CORRECTED SB VOLTAGE (VOLTS) |
|---|---|
| FIRST CH VOLTAGE (Va) | (CURRENT SB VOLTAGE)+100 |
| SECOND CH VOLTAGE (Vb) | (CURRENT SB VOLTAGE)+80 |
| THIRD CH VOLTAGE (Vc) (CURRENT SETTING) | (CURRENT SB VOLTAGE)+60 |
| FOURTH CH VOLTAGE (Vd) | (CURRENT SB VOLTAGE)+40 |
| FIFTH CH VOLTAGE (Ve) | (CURRENT SB VOLTAGE)+20 |
| NO POOR CONDITION OCCURS | (CURRENT SB VOLTAGE) |

(FIRST TO FIFTH CH VOLTAGES ARE NEGATIVE VOLTAGES)

| CH VOLTAGE WHEN POOR CONDITION OCCURS (VOLTS) | CORRECTED SB VOLTAGE (VOLTS) |
|---|---|
| FIRST CH VOLTAGE (Va) | (FIRST CH VOLTAGE)-100 |
| THIRD CH VOLTAGE (Vc) (CURRENT SETTING) | (THIRD CH VOLTAGE)-100 |
| FIFTH CH VOLTAGE (Ve) NO POOR CONDITION OCCURS | (FIFTH CH VOLTAGE)-100 (THIRD CH VOLTAGE)+50 |

(FIRST TO FIFTH CH VOLTAGES ARE NEGATIVE VOLTAGES)

| CH VOLTAGE WHEN POOR CONDITION OCCURS | SOILING LEVEL |
|---|---|
| FIRST CH VOLTAGE | LEVEL 5 |
| SECOND CH VOLTAGE | LEVEL 4 |
| THIRD CH VOLTAGE (CURRENT) | LEVEL 3 |
| FOURTH CH VOLTAGE | LEVEL 2 |
| FIFTH CH VOLTAGE | LEVEL 1 |
| ALL GOOD | LEVEL 0 |

IMAGE FORMING APPARATUS HAVING A TRANSPORTING UNIT, A DETECTOR AND A VOLTAGE CONTROLLER

BACKGROUND OF THE INVENTION

1. Field of the Invention

The present invention relates to an electrophotographic image forming apparatus, and more particularly to an image forming apparatus capable of adjusting print density.

2. Description of the Related Art

Image forming apparatuses such as an electrophotographic printer use an electrophotographic image forming process including steps of charging, exposing, developing, transferring, and fixing. A charging roller charges the surface of a photoconductive drum uniformly. An exposing unit employs a light source such as LEDs or a laser, and selectively illuminates the charged surface of the photoconductive drum to form an electrostatic latent image. The electrostatic latent image is then developed with charged toner into a toner image. The toner image is transferred onto a print medium, and finally fused by a fixing unit into a permanent image. The density of toner images may change with time and environmental changes. Additionally, toner may adhere to areas in which no electrostatic latent image is formed, leading to soiling of the surface of the photoconductive drum. One conventional way of solving this type of soiling of the photoconductive drum is to adjust the charging voltage that charges the surface of the photoconductive drum.

However, while soiling of the photoconductive drum may be prevented by adjusting the charging voltage, soiling of the printed images due to abnormally charged toner may be difficult to prevent.

SUMMARY OF THE INVENTION

An object of the invention is to provide am image forming apparatus in which the soiling of the photoconductive drum due to deterioration of a charging unit, charging performance, image bearing body, and abnormally charged toner may be prevented.

An image forming apparatus includes at least one image forming section, which includes an image bearing body, a charging unit that charges an area on a surface of the image-bearing body, and a developing unit that supplies a developer material to the charged area to form a developer image on the image bearing body. The developer image is transferred from the image-bearing body onto a transporting unit. A detector detects a density of the developer image on the transporting unit. The controller performs a charging voltage correcting operation in which the controller provides a test charging voltage to the charging unit for forming the developer image, and then a normal charging voltage for normal printing is determined based on the density. The controller also performs a developer-supplying voltage correcting operation in which a developer-supplying voltage supplied to a developer supplying unit is determined based on the density.

An image forming apparatus includes at least one image forming section, wherein the image forming section includes an image bearing body, a charging unit that charges an area on a surface of the image bearing body, a developing unit that supplies a developer material to the charged area to form a developer image on the image bearing body, and a developer-supplying unit that supplies the developer material to the developing unit. The image forming apparatus includes a transporting unit, a detector, and a voltage controller. The developer image is transferred onto the transporting unit from the image bearing body. The detector detects a density of the developer image on said transporting unit. The voltage controller provides a test charging voltage for forming the developer image on the image bearing body to the charging unit and a developer-supplying voltage to the developer-supplying unit. The voltage controller performs a developer-supplying voltage correcting operation in which said voltage controller provides the test charging voltage to the charging unit, and then determines a developer-supplying voltage based on the density detected by said detector.

Further scope of applicability of the present invention will become apparent from the detailed description given hereinafter. However, it should be understood that the detailed description and specific examples, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 12 is a graph illustrating the distribution of potential of toner for different toner supply voltages SB (SB voltage);

FIG. 13 is a table illustrating how the correction of the SB voltage is made when the image forming apparatus is determined to be in poor condition;

DETAILED DESCRIPTION OF THE INVENTION

First Embodiment

Figure 1:
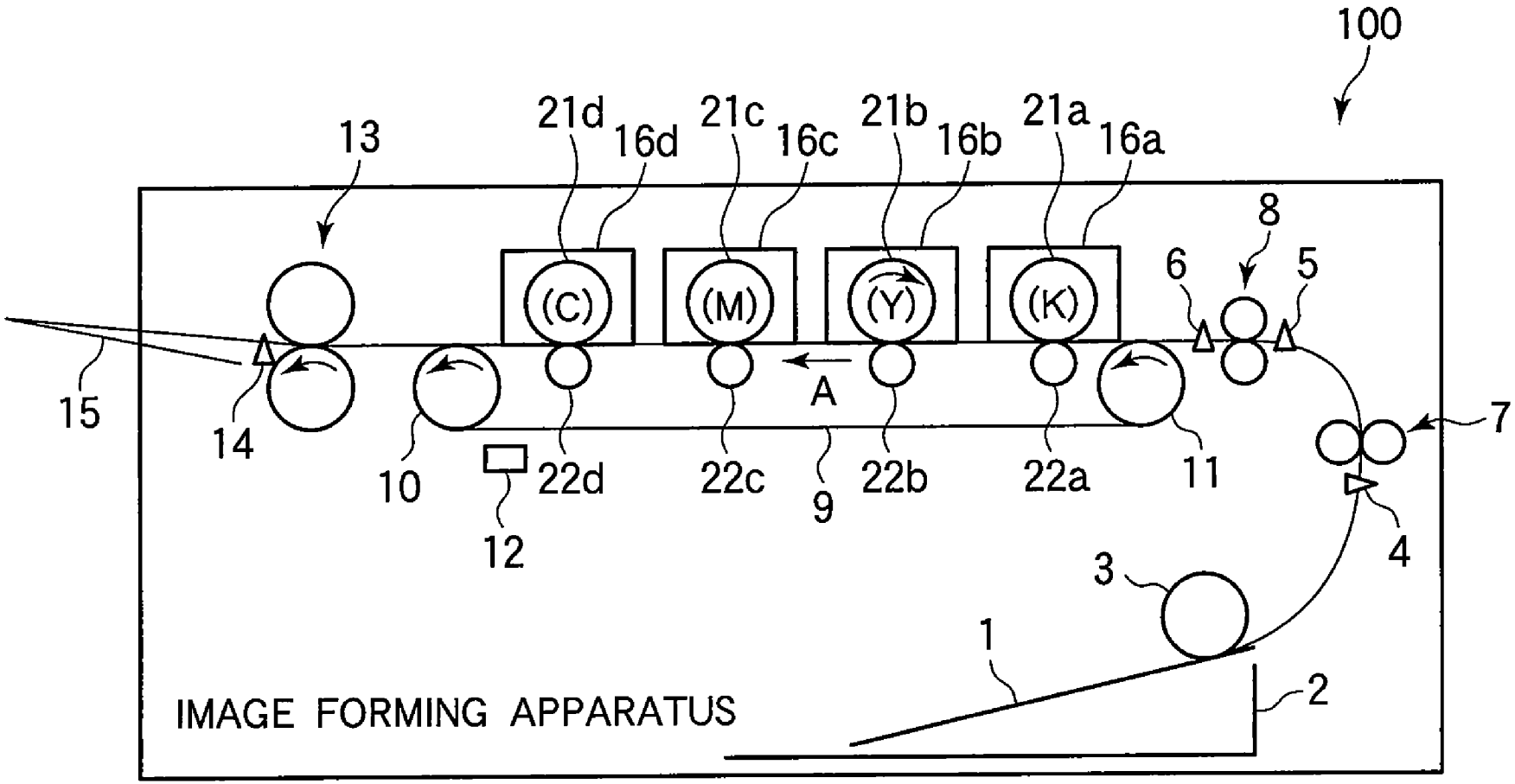
FIG. 1 illustrates a pertinent portion of an image forming apparatus of a first embodiment.

FIG. 1 illustrates a pertinent portion of an image forming apparatus 100 of a first embodiment.

The image forming apparatus 100 takes the form of a color electrophotographic printer. A paper cassette 2 holds a stack of recording medium 1, and a feed roller 3 feeds the recording medium 1 into a transport path on a page-by-page basis. The recording medium 1 is transported by a first registration roller 7 and a second registration roller 8 to an image forming section 16*a*. A first sensor 4 is disposed immediately upstream of the first registration roller 7, and a second sensor 5 is disposed immediately upstream of the second registration roller 8. A third sensor 6 is disposed immediately downstream of the second registration roller 8, and detects timing at which the leasing end of recording medium 1 arrives at the image forming section 16*a*.

A transport belt 9 is entrained about a pair of drive rollers 10 and 11, and is driven to run in a direction shown by arrow A. The transport belt 9 runs along the transport path with the recording medium 1 placed thereon.

The black (K), yellow (Y), magenta (M), and cyan (C) image forming sections 16*a*, 16*b*, 16*c*, and 16*d* are aligned in this order along the transport path 9. Numerals alone refer to the same thing as the numerals with letters.

The image forming sections 16*a*-16*d* include photoconductive drums 21*a*-21*d*, respectively. The photoconductive drums 21*a*-21*d* rotate in contact with the transport belt 9. Transfer rollers 22*a*-22*d* parallel the photoconductive drums 21*a*-21*d*, and the transport belt 9 is sandwiched between the transfer rollers 22*a*-22*d* and the photoconductive drums 21*a*-22*d*. Transfer voltages are applied to the respective transfer rollers 22*a*-22*d* at predetermined timings. Numerals alone refer to the same thing as the numerals with letters.

As the recording medium passes through the respective image forming sections, toner images of corresponding colors are transferred onto the recording medium 1 one over the other in registration. When the recording medium 1 passes through a fixing point defined between fixing rollers 13, the toner images on the recording medium are fused under heat and pressure into a permanent image. A fourth sensor 14 is disposed downstream of the fixing roller 13 to detect the leading end of the recording medium 1 leaving the fixing rollers 13. The recording medium 1 then passes by the fourth sensor 14, and is discharged onto a stacker 15.

Figure 2A:
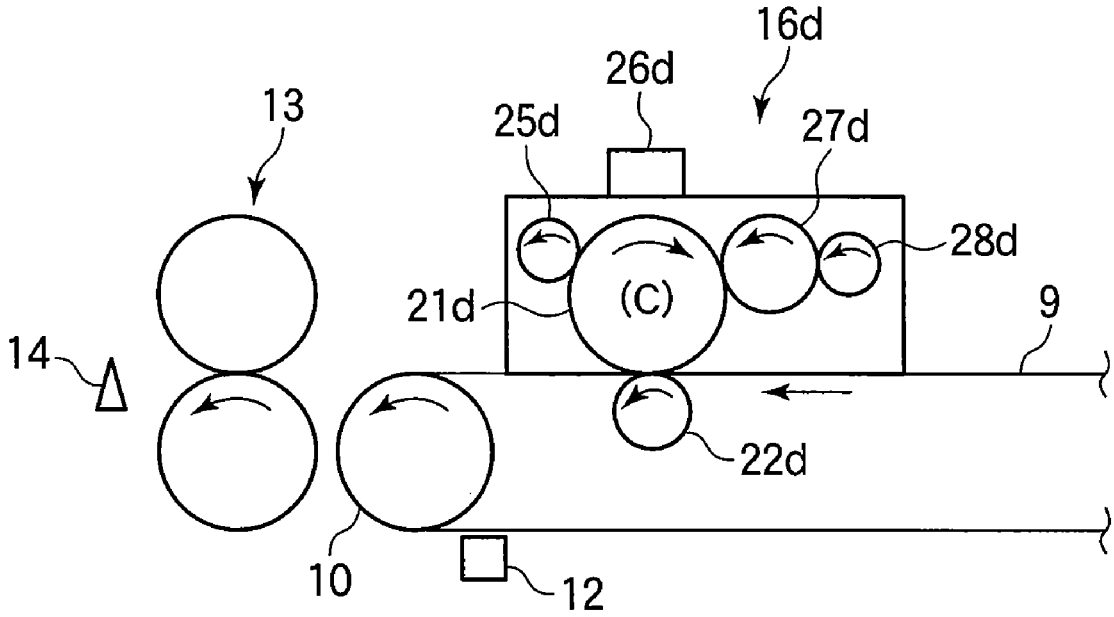
FIG. 2A is a partial enlarged view of a vicinity of the cyan image forming section.
Figure 2B:
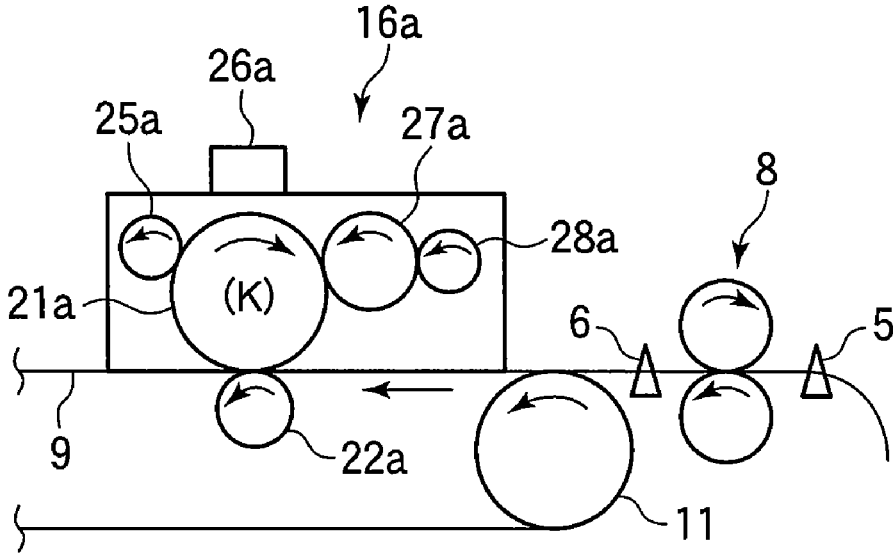
FIG. 2B is a partial enlarged view of a vicinity of the black image forming section.

FIG. 2A is a partial enlarged view of the vicinity of the cyan image forming section 16*d*. FIG. 2B is a partial enlarged view of the vicinity of the black image forming section 16*a*.

Referring to FIG. 2A, a charging roller 25*d*, an LED printhead 26*d*, a developing roller 27*d*, and a transfer roller 22*d* are disposed around the photoconductive drum 21*d* in this order from upstream to downstream with respect to rotation of the photoconductive drum 21*d*. The charging roller 25*d* charges the surface of the photoconductive drum 21*d* uniformly. The LED printhead illuminates the charged surface of the photoconductive drum 21*d* to form an electrostatic latent image. The developing roller 27*d* supplies toner to the electrostatic latent image to form a toner image. The transfer roller 22*d* transfers the toner image onto the recording medium. A toner supplying roller 28*d* supplies the toner (cyan) to the surface of the developing roller 27*d*.

A density sensor 12 is disposed at a downstream end in the vicinity of the transfer belt 10. The density sensor 12 detects the density of a pattern printed on the transfer belt 9.

Referring to FIG. 2B, a charging roller 25*a*, an LED printhead 26*a*, a developing roller 27*a*, and a transfer roller 22*a* are disposed around the photoconductive drum 21*a* in this order from upstream to downstream with respect to rotation of the photoconductive drum 21*a*. The charging roller 25*d* charges the surface of the photoconductive drum 21*a* uniformly to a negative potential. The LED printhead 26*a* illuminates the charge surface of the photoconductive drum 21*d* to form an electrostatic latent image. The developing roller 27*d* supplies toner to the electrostatic latent image to form a toner image. The transfer roller 22*a* transports the toner image onto the recording medium. A toner supplying roller 28*a* supplies the toner (cyan) to the surface of the developing roller 27*a*.

Referring to FIG. 2B, the recording medium 1 is advanced by the second registration roller 8, and passes by the third sensor 6 toward the drive roller 11. Then, the recording medium 1 is attracted to the transfer belt 9, and is further transported through the respective image forming sections in sequence.

Likewise, the image forming sections for yellow and magenta images may be substantially identical with those for black and cyan images, and their detailed description is omitted.

Figure 3:
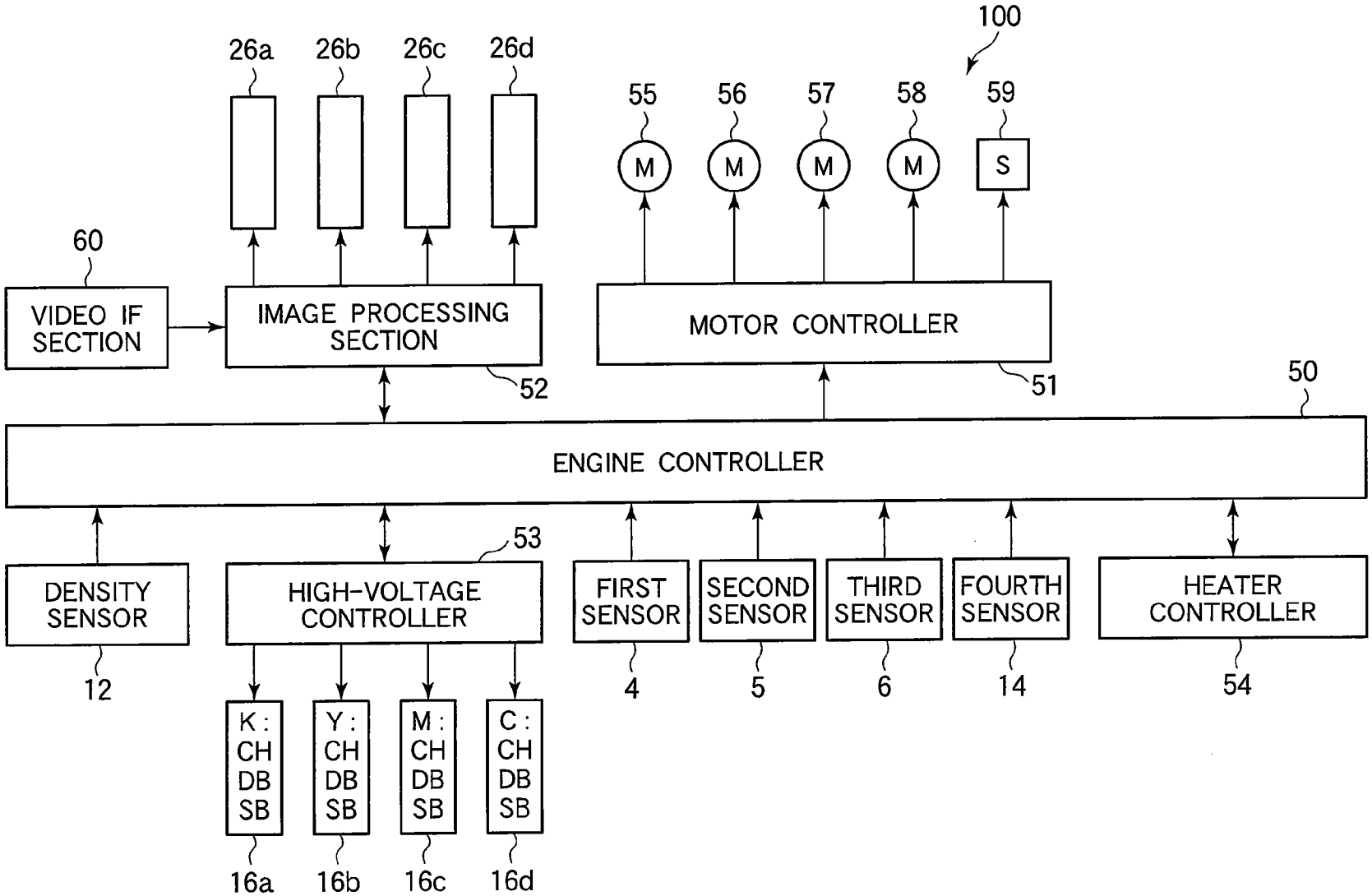
FIG. 3 is a block diagram illustrating a pertinent portion of a control section for the image forming apparatus.

FIG. 3 is a block diagram illustrating a pertinent portion of a control section for the image forming apparatus 100.

Referring to FIG. 3, an engine controller 50 is a central part of the overall control for the apparatus. The engine controller 50 obtains various items of information from the density sensor 12, first to fourth sensors 4-6 and 12. The engine controller 50 then provides commands to an image processing section 52, a motor controller 51, a high-voltage controller 53, a heater controller 54. The image processing section 52 outputs image data to the LED printhead 26 in response to image information received from a video IF section 60 and the commands received from the engine controller 50. The motor controller 51 controls a paper-feeding motor 55, a belt motor 56, an image drum (ID) motor 57, a heater motor 58, and a paper-feeding solenoid 59.

In response to the command from the engine controller 50, the high-voltage controller 53 controls a negative charging voltage CH (referred to as CH voltage hereinafter) that is applied to the charging roller 25, a negative developing voltage DB (referred to as DB voltage hereinafter) that is applied to the developing roller 27 (FIG. 2), and a negative toner-supplying voltage SB (referred to as SB voltage hereinafter) that is applied to the toner supplying roller 28 (FIG. 2). The high-voltage controller 53 also controls the transfer voltage TR (referred to as TR voltage hereinafter) applied to the transfer roller 22.

Figure 4:
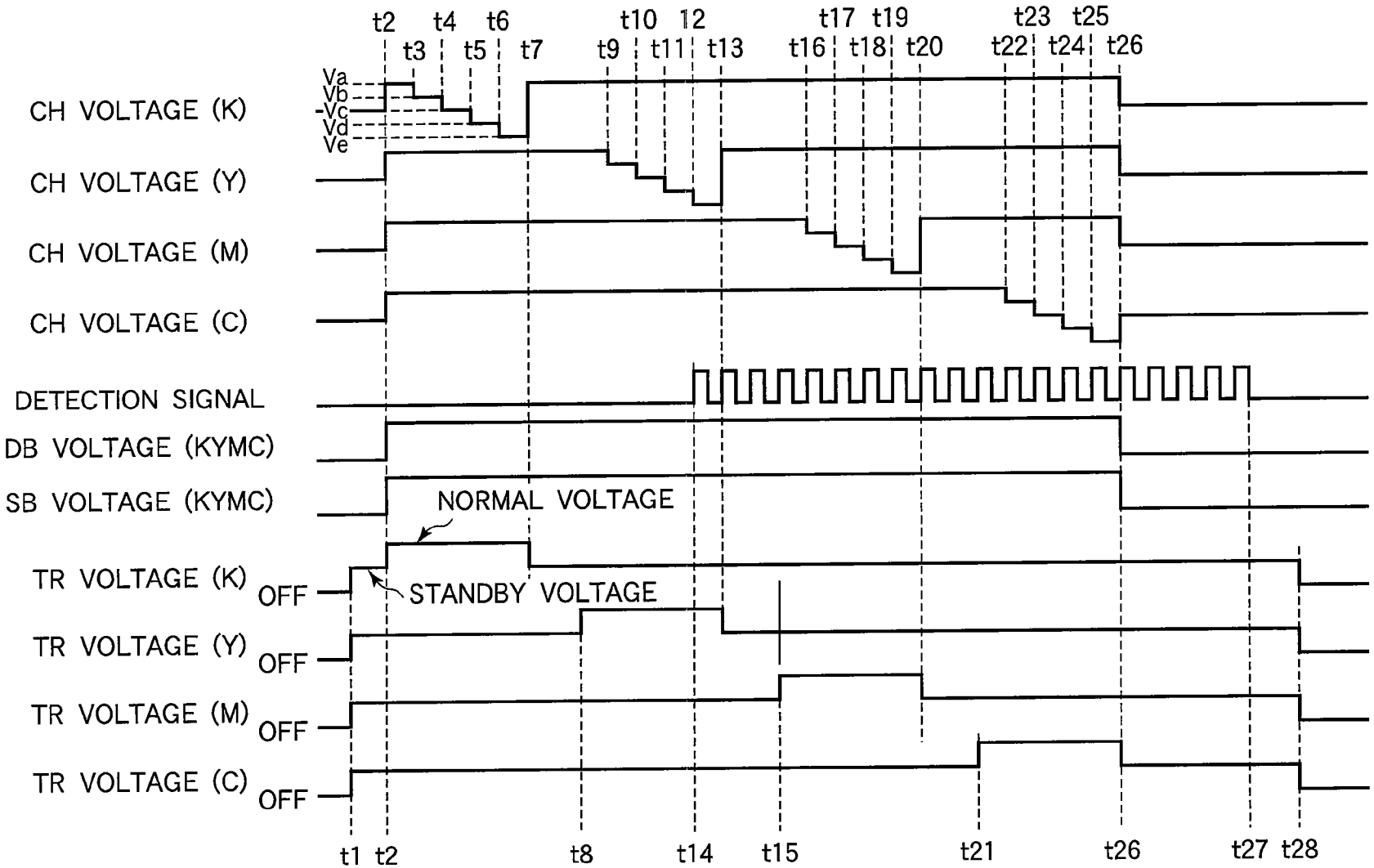
FIG. 4 is a timing chart illustrating changes of various voltages controlled by the high-voltage controller.

FIG. 4 is a timing chart illustrating changes of various voltages controlled by the high-voltage controller 53. The level of soiling due to toner-drum potential difference and soiling due to oppositely charged toner may be detected by detecting a density detection pattern (which will be described later) while changing the CH voltage stepwise in the order of Va, Vb, Vc Vd, and Ve. The operation of the image forming apparatus for detecting the level of soiling due to toner-drum potential difference and soiling due to oppositely charged toner will be described with reference to FIG. 4 as well as FIGS. 1-3.

The engine controller 50 outputs a correction command for the CH voltage. In response to the correction command, the motor controller 51 drives the belt motor 56 to rotate the transport belt 9, and the ID motor 57 to rotate the photoconductive drum 21. The drive force of the ID motor 57 is also transmitted via a rotation transmitting means to the transfer roller 22, charging roller 25, developing roller 27, and toner supplying roller 28. The high-voltage controller 53 outputs high voltages shown in the timing chart in FIG. 4 in response to a control signal received from the engine controller 50.

The density detection pattern for detecting the image density is formed on the transport belt 9 with the LED printhead 26 set inoperable. In other words, the light emitting diodes of the LED printhead 26 do not illuminate the surface of the photoconductive drum 21, and therefore FIG. 4 does not illustrate the control of the LED printhead.

At time t1, the transfer voltages TR for the four colors (black, yellow, magenta, and cyan) are set an "OFF-state voltage". At time t2, the high-voltage controller 53 outputs a DB voltage to the developing roller 27, an SB voltage to the toner supplying roller 28, and a CH voltage to the charging roller 25. The CH voltages for the four colors change stepwise in the order of Va, Vb, Vc, Vd, and Ve. The CH voltage at time t2 is a first CH voltage Va (maximum absolute value).

Density detection patterns for the respective colors are printed in sequence beginning from the black image forming section (K). The high-voltage controller 53 applies the CH voltage of various levels to the charging roller 25*a* in sequence: the first CH voltage Va at time t2, a second CH voltage Vb at time t3, a third CH voltage Vc at time t4, a fourth CH voltage Vd at time t5, a fifth CH voltage Ve at time t6, and the first CH voltage Va at time t7. As the photoconductive drum 21*a* (black) rotates, the areas on the surface of the photoconductive drum 21*a* charged by the first to fourth CH voltages are brought into contact with the developing roller 27 such that the charged areas are developed with the toner into developer images (i.e., segments of a developed detection pattern). The developer images are then transferred as a density detection pattern onto the transport belt 9.

The duration of the first to fourth CH voltages is selected by taking the transport speed of the transport belt 9, the ability of the density sensor 12 to detect the density, and the processing speed of the engine controller 50 into account. The duration should be sufficiently long so that the detection pattern may be read accurately from the transport belt 9 running at a predetermined transport speed. The duration should also be sufficiently long so that the detection pattern may be read optically and converted into a voltage signal. Further, the duration should also be sufficiently long so that an A/D converter may accurately sample the voltage signal into a digital signal and the controller 50 may process the digital signal accurately. In order to process the signals in a short time and use as small an amount of toner as possible, the duration of the first to fourth CH voltages should be as short as possible provided that the aforementioned conditions are met.

In the first embodiment, the CH voltages are incremented above the third CH voltage Vc, and are decremented below the third CH voltage Vc, assuming that the third CH voltage Vc is a median. A sufficiently small size of increments should be selected in accordance with the characteristics of the image forming apparatus. An experimental size of 50 volts has been found sufficiently small in determining an optimum CH voltage.

Referring to FIG. 4, the CH voltage includes five voltages Va, Vb, Vc, Vd, and Ve in the order from highest to lowest. As described above, a developer image having five segments is formed on the transport belt 9 by applying the CH voltages in an increment of 50 volts. The DB voltage and SB voltage are applied to the developing roller 27 and the toner supplying roller 28, respectively, in synchronism with the CH voltage. A transfer voltage TR is also applied to the transfer roller 22*a* in synchronism with the CH voltage Va, DB voltage, and SB voltage, thereby transferring the developer image from the photoconductive drum 21*a* onto the transport belt 9.

Likewise, the CH voltage for the image forming section 16*b* is applied to the charging roller 25 for a period of t8-t13 to form a developer image of yellow on the photoconductive drum 21*b*. The CH voltage for image forming section 16*c* is applied to the charging roller for a period of t15-t20 to form a detection pattern of magenta on the photoconductive drum 21*c*. The CH voltage for image forming section 16*d* is applied to the charging roller for a period of t21-t26 to form a detection pattern of cyan on the photoconductive drum 21*d*. The density detection patterns for yellow, magenta, and cyan are transferred onto the transport belt 9 at similar timings to the density detection pattern for black.

The areas (i.e., segments of the density detection pattern) on the photoconductive drum 21 charged by different CH voltages reach a transfer point defined between the transfer roller 22 and the photoconductive drum 21 at timings displaced by a predetermined amount of time. For simplicity, the displacement in timing is not shown in FIG. 4.

The leading end of the density detection pattern for black printed on the transport belt 9 reaches the density sensor 12 at time t14. The density sensor 12 detects the density of the respective segments of the density detection pattern for black, and provides a detection output to the engine controller 50, the detection output including the values of density of the segments aligned in the order of the CH voltage of Va, Vb, Vc, Vd, and Ve.

The deterioration of the charging roller 25 and deposition of toner on the charging roller 25 may cause poor charging performance of the charging roller 25. The poor charging performance of the charging roller 25, the deterioration of the photoconductive drum 21, and the abnormal charging of the toner cause serious damage to the image forming apparatus. As a result, a segment formed by a CH voltage closer to the first CH voltage Va tends to have a density greater than a reference level. An image forming apparatus in good condition, i.e., free from soiling due to toner-drum potential difference, may have satisfactory densities at five different CH voltages Va, Vb, Vc, Vd, and Ve, which will be described later with reference to FIGS. 6 and 7.

The reference level is previously stored in a memory means (not shown) within the engine controller 50. The reference level is read from the memory means, and is compared with the detection output of the density sensor 12.

For the black density detection pattern, the density sensor 12 detects light due to regular reflection. When no toner is deposited on the transport belt 9 (therefore, regular reflection), the detection output of the density sensor 12 is high. The amount of toner deposited on the transport belt 9 increases with increasing level of soiling, so that diffusion reflection becomes dominant causing the detection output to decrease.

For the color density detection pattern, the density sensor 12 detects light due to diffusion reflection. When no toner is deposited on the transport belt 9 (therefore, regular reflection), the detection output of the density sensor 12 is low. The amount of toner deposited on the transport belt 9 increases with increasing level of soiling, so that regular reflection becomes less dominant causing the detection output to increase.

Figure 6:
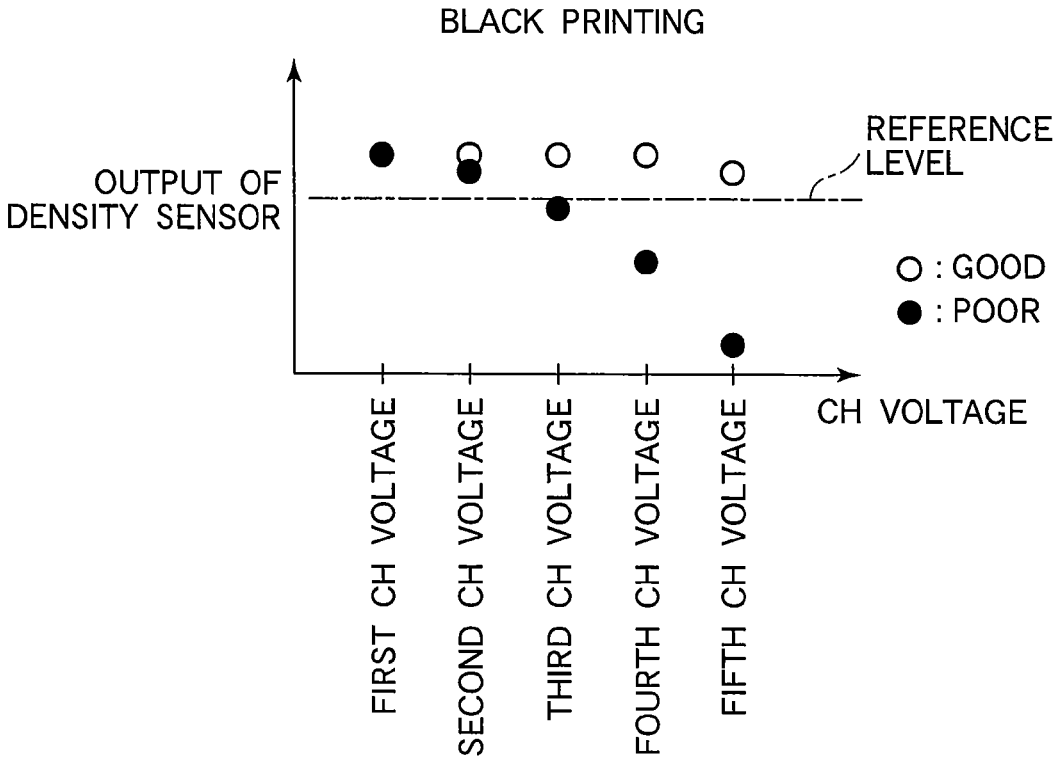
FIG. 6 illustrates the detection output of a density sensor when a black density detection pattern is tested using an image forming apparatus that has been soiled and an image forming apparatus that has not been soiled.
Figures 7, 8:
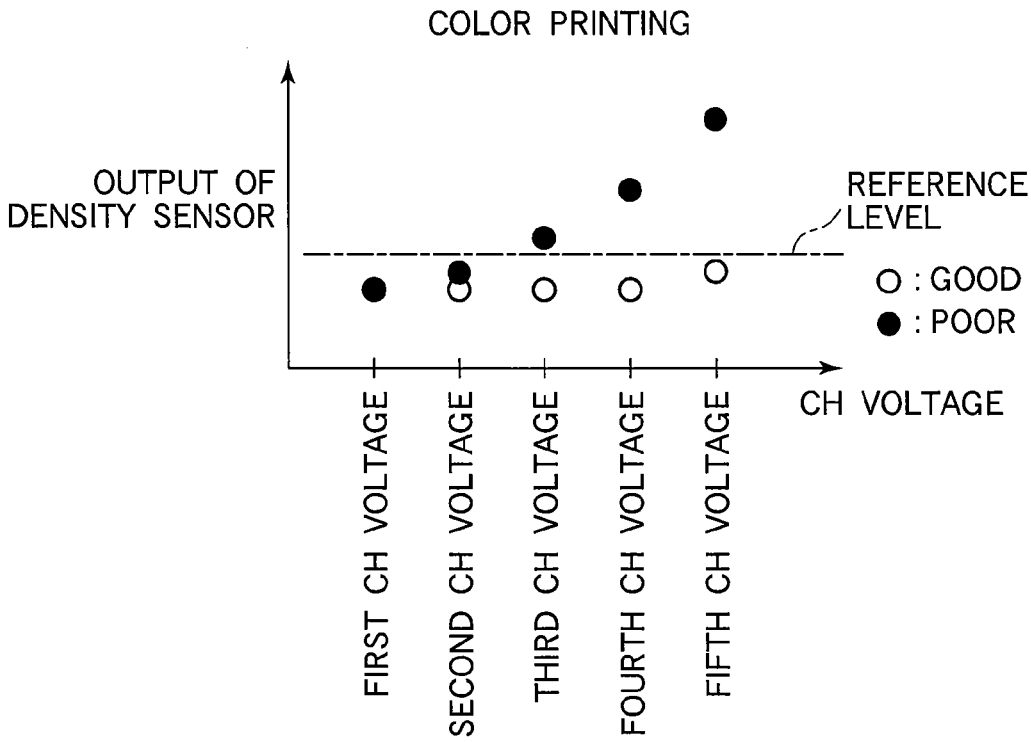
FIG. 7 illustrates the detection output of the density sensor when a color density detection pattern is tested using an image forming apparatus that has been soiled and an image forming apparatus that has not been soiled.
FIG. 8 is a table illustrating how the correction of CH voltage is made when the image forming apparatus is determined to be in poor condition (soiled)

Therefore, for black density detection pattern, when the detection output of the density sensor 12 is higher than the reference level, the image forming apparatus is in good condition as shown in FIG. 6. For color detection pattern, when the detection output of the density sensor 12 is lower than the reference level, the image forming apparatus is in good condition as shown in FIG. 7. Four different reference levels may be used for four colors.

{Relation Between Soiling and CH Voltage}

Figure 9:
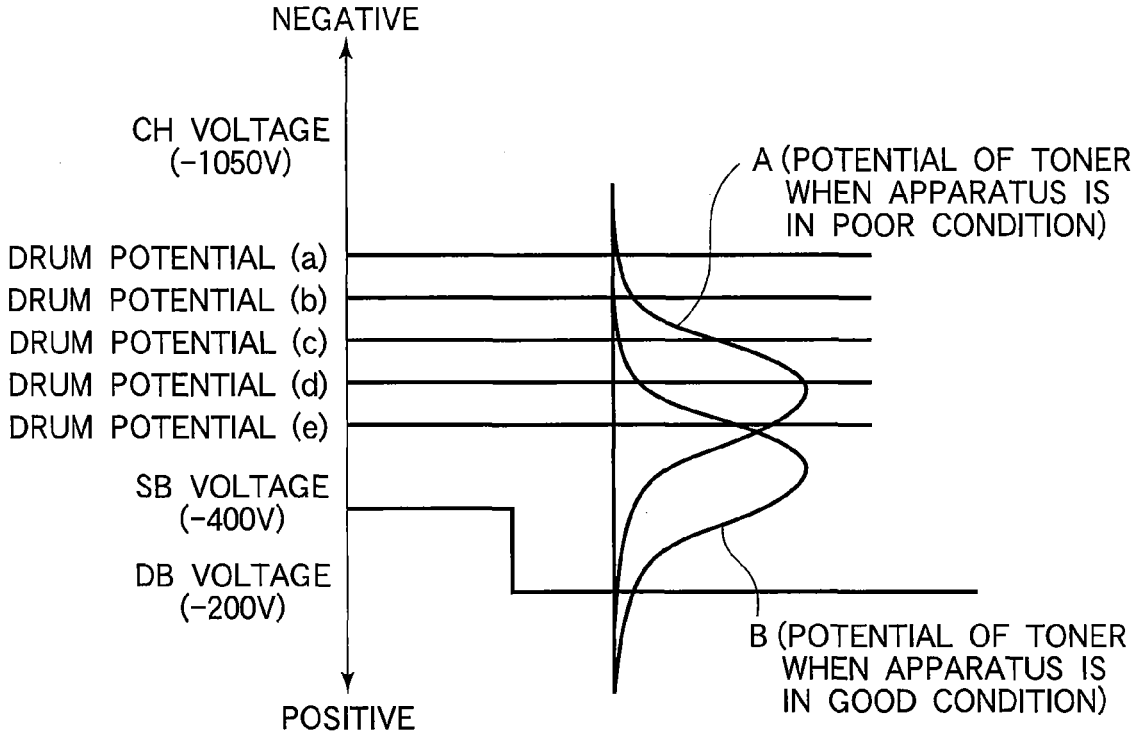
FIG. 9 illustrates the relationship between the soiling due to toner-drum potential difference and changes in the CH voltage.

FIG. 9 illustrates the relationship between the soiling and changes in CH voltage. Referring to FIG. 9, surface potentials Va to Ve of the photoconductive drum 21 correspond to five CH voltages Va, Vb, Vc, Vd, and Ve when the third CH voltage (Vc) is set to −1050 volts. Curves A and B illustrate normal distribution of potential on the toner particles deposited on the developing roller 27.

Soiling due to potential difference is caused by deposition of charged toner particles on the surface of the photoconductive drum 21, the potential (absolute value) being higher on the surface of the toner particles than on the surface of the photoconductive drum 21.

When the potential on the toner particles is distributed as shown in Curve A, if the surface potential of the photoconductive drum is Vd or Ve, then soiling due to toner-drum potential is prominent. This is because the toner particles having a higher potential (absolute value) than the surface of the photoconductive drum 21 represents a large portion of the distribution of potential of the toner particles.

When the potential of the toner particles are distributed as shown in Curve B, if the surface potential of the photoconductive drum 21 is Ve, then soiling due to toner-drum potential is not prominent. This is because the toner particles having a higher potential (absolute value) than the surface of the photoconductive drum 21 represents only a small portion of the distribution of potential of the toner particles.

Thus, in order to prevent soiling due to toner-drum potential, the CH voltage may be increased from Vc to Va relative to Curve A, so that the relationship between the CH voltage and the entire distribution is similar to that between CH voltage Vc and Curve B.

The deterioration of the charging roller 25 and deposition of toner on the charging roller 25 may cause poor charging performance of the charging roller 25. The poor charging performance of the charging roller 25 and/or the deterioration of the photoconductive drum 21 may cause the absolute value of surface potential of the photoconductive drum 21 to become small even though the CH voltage applied to charging roller 25 remains unchanged. Abnormally charged toner causes the distribution of potential of the toner particles to shift toward a larger absolute value of potential relative to the surface potential of the photoconductive drum 21. What these two phenomena have in common is that the absolute value of the potential of the toner becomes larger than that of the photoconductive drum 21. In order to solve this problem, the CH voltage is increased in absolute value such that the corrected CH voltage does not cause soiling due to toner-drum potential.

When a CH voltage for normal printing is to be determined based on the CH voltage at which the image forming apparatus is found to be in poor condition, the CH voltage for normal printing should allow for a certain margin against soiling due to oppositely charged toner. Soiling is caused by toner charged to a polarity opposite to the polarity to which the toner is intended to be charged. Thus, soiling is apt to occur with increasing absolute value of the surface potential of the photoconductive drum 21. The margin for soiling should be as small as possible, provided that both soiling due to toner-drum potential and soiling due to oppositely charged toner are prevented.

{Correction of CH Voltage}

Figure 5:
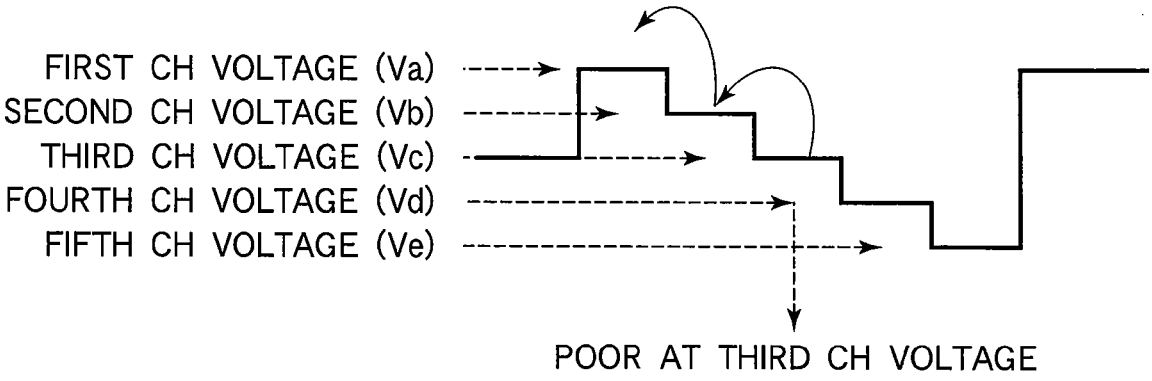
FIG. 5 illustrates the method for correcting the CH voltage when it is determined that the image forming apparatus has been soiled.

A description will be given of a method for correcting the CH voltage based on the comparison of the detection output of the density sensor 12 with the reference level. FIG. 5 illustrates the method for correcting the CH voltage when it is determined that the image forming apparatus has been soiled.

Referring to FIG. 5, it is assumed that soiling due to toner-drum potential of the image forming apparatus is detected at the third CH voltage (Vc). A simple way of correcting the CH voltage is to simply set the CH voltage to a voltage having an absolute value larger than the third CH voltage by 100 volts.

FIG. 6 illustrates the detection output of the density sensor 12 when a black density detection pattern is tested using an image forming apparatus that has been soiled and an image forming apparatus that has not been soiled. FIG. 7 illustrates the detection output of the density sensor 12 when a color density detection pattern is tested using an image forming apparatus that has been soiled and an image forming apparatus that has not been soiled.

Referring to FIG. 6, densities above the reference level indicate good condition. If the densities at five CH voltages are above the reference level, then the image forming apparatus is in good condition. If at least one of the five CH voltages causes a detection output below the reference level, then the image forming apparatus is in poor condition.

Referring to FIG. 7, densities below the reference level indicate good condition. If the densities at five CH voltages are below the reference level, then the image forming apparatus is in good condition. If at least one of the five CH voltages causes a detection output above the reference level, then the image forming apparatus is in poor condition.

FIG. 8 is a table illustrating how the correction of CH voltage (i.e., setting of charging voltage for a normal printing operation) is made when the image forming apparatus is found to be in poor condition.

Referring to FIG. 8, when the image forming apparatus is determined to be in poor condition at any one of the five CH voltages Va, Vb, Vc, Vd, and Ve, the CH voltage that caused the poor condition is increased by 100 volts (i.e., CH voltage is set to a larger absolute value), and is used as a corrected CH voltage or charging voltage for a normal printing operation. When the image forming apparatus is determined to be in good condition at five CH voltages, the CH voltage is set to "(current third CH voltage Vc)+50 V" (i.e., CH voltage is smaller in absolute value).

Figure 10:
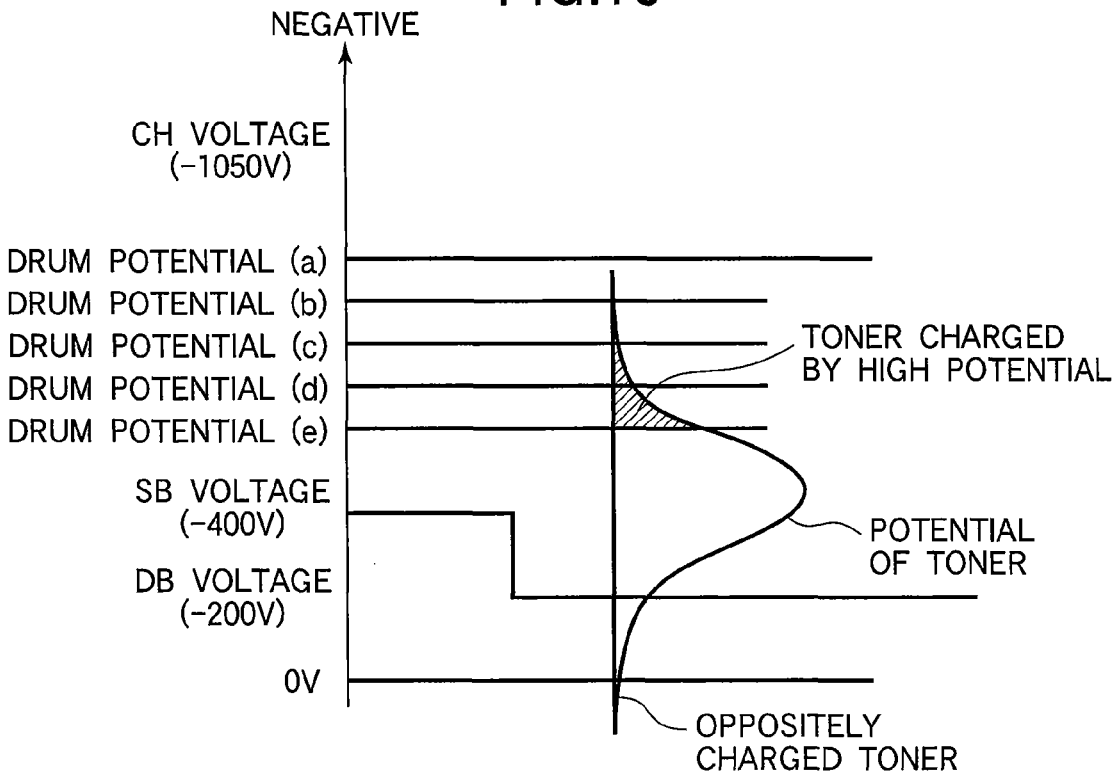
FIG. 10 illustrates an idea of correcting the CH voltage such that a substantially the same margin may be allowed for soiling due to toner-drum potential difference and soiling due to oppositely charged toner.

FIG. 10 illustrates an idea of correcting the CH voltage such that a substantially the same margin may be allowed for soiling due to toner-drum potential and soiling due to oppositely charged.

If the potential of the toner is distributed as shown in FIG. 10, the CH voltage may be increased to a higher voltage (e.g., Vb) for increasing the surface potential of the photoconductive drum 21, so that the potential of the surface of the photoconductive drum 21 remains more negative than that of most of the toner, thereby minimizing the chance of soiling occurring. In other words, a margin should be added to the CH voltage at which soiling occurs, thereby increasing the absolute value of the CH voltage. Too large a margin causes soiling to be prominent due to oppositely charged toner (positively charged toner). Experiment reveals that the difference between a CH voltage at which soiling due to high potential of toner just disappears and a CH voltage at which soiling due to oppositely charged toner appears is larger than 100 volts on average. This difference is fairly large. In the present embodiment, the margin is selected to be 100 volts.

Figure 11:
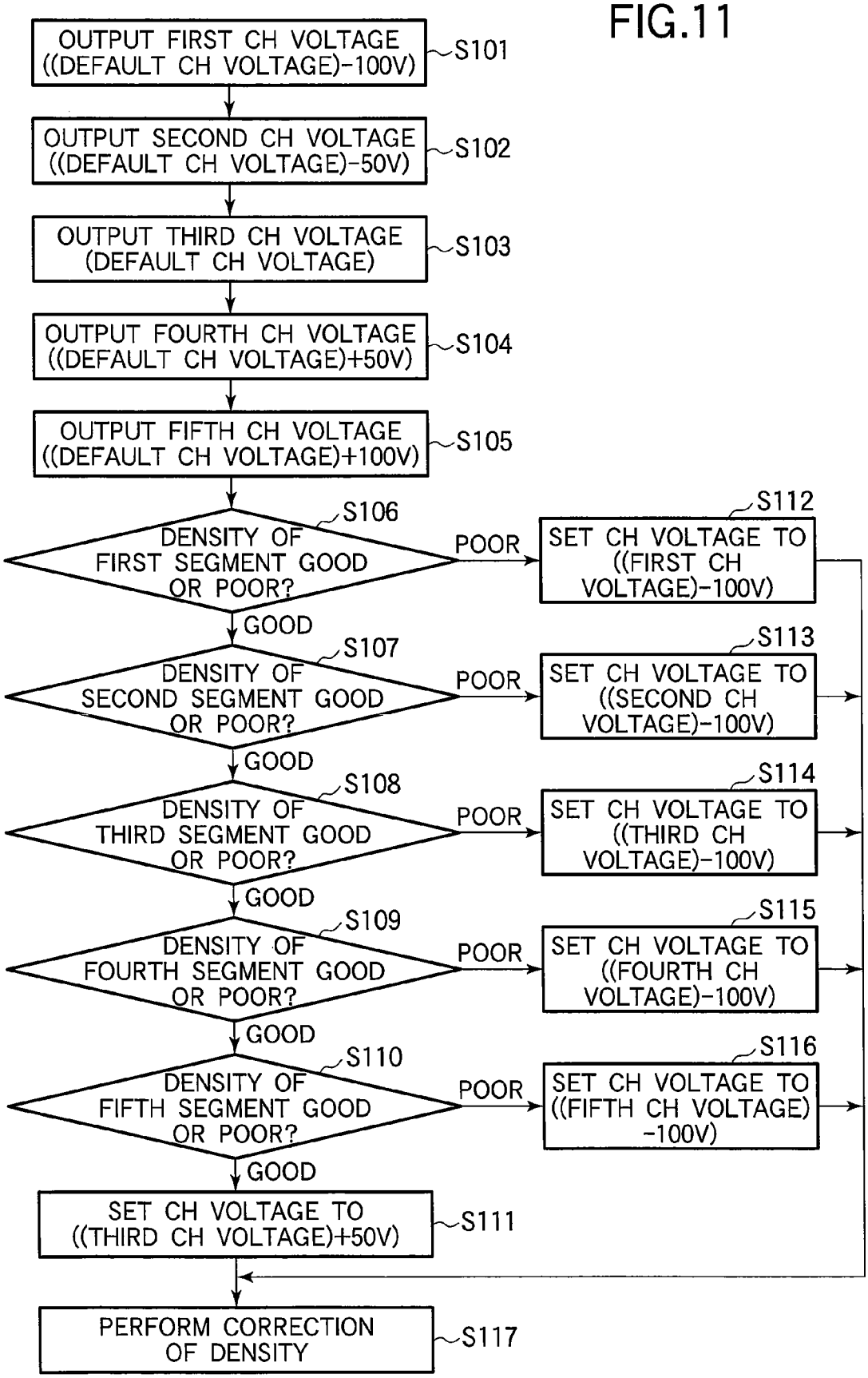
FIG. 11 is a flowchart illustrating the procedure in which the correction of the CH voltage is made by an engine controller.

FIG. 11 is a flowchart illustrating the procedure in which the correction of the CH voltage is made by the engine controller 50. As described in FIG. 4 the correction is made for the respective image forming sections 16*a* to 16*d* in sequence. The procedure is the same for all image forming sections 16*a* to 16*d*. Thus, the following description applies to the image forming sections 16*a* to 16*d*.

S101: The image forming section 16 is ready to form a density detection pattern on the transport belt 9. A first CH voltage (Va), which is equal to "(default CH voltage)−100 V", is applied to the charging roller 25 (FIG. 2) for a predetermined period of time.

S102: A second CH voltage (Vb), which is equal to "(default CH voltage)−50 V", is applied to the charging roller 25 for a predetermined period of time.

S103: A third CH voltage (Vc), which is equal to "(default CH voltage)", is applied to the charging roller 25 (FIG. 2) for a predetermined amount of time.

S104: A fourth CH voltage (Vd), which is equal to "(default CH voltage)+50 V", is applied to the charging roller 25 for a predetermined period of time.

S105: A fifth CH voltage (Ve), which is equal to "(default CH voltage)−100 V", is applied to the charging roller 25 for a predetermined period of time.

As the photoconductive drum rotates, the areas on the photoconductive drum 21 charged by the first to fifth CH voltages, respectively, are brought into contact with the developing roller 27 in sequence, so that the areas are developed with the toner into segments of the density detection pattern. The segments are then transferred onto the transport belt 9 sequentially so that the density detection pattern having five segments lies on the transport belt 9. As the transport belt 9 runs, the segments of the density detection pattern passes by the density sensor 12.

S106: The density sensor 12 detects the density of the first segment formed by the first CH voltage (Va). The detected density is then compared with the reference.

S112: If the density of the first segment is poor at S106, the first CH voltage is corrected to "(first CH voltage)−100 V."

S117: Then, a variety of density corrections are made.

At S117, a variety of corrections are made in addition to the correction of the CH voltage. For example, the LED printhead is energized to print a test pattern on the transport belt 9, and the density of the test pattern is detected. The detected density is compared with a reference density previously stored in a memory. Then, based on the comparison result, corrections are made of the amount of light emitted from the LED printhead and the settings for high voltages including the developing voltage DB and the SB voltage.

S107: If the density of the first segment is good at S106, then the density sensor 12 detects the density of a second segment formed by the second CH voltage (Vb). The detected density is then compared with the reference.

S113: If the density of the second segment is poor at S107, the second CH voltage is corrected to "(second CH voltage)−100 V."

S117: Then, a variety of density corrections are made.

S108: If the density of the second segment is good at S107, then the density sensor 12 detects the density of a third segment formed by the third CH voltage (Vc). The detected density is compared with the reference.

S114: If the density of the third segment is poor at S108, the third CH voltage is corrected to "(third CH voltage)−100 V."

S117: Then, a variety of density corrections are made.

S109: If the density of the third segment is good at S108, then the density sensor 12 detects the density of a fourth segment formed by the fourth CH voltage (Vd). The detected density is then compared with the reference.

S115: If the density of the segment is poor at S109, the fourth CH voltage is corrected to "(fourth CH voltage)−100 V."

S117: Then, a variety of density corrections are made.

S110: If the density of the fourth segment is good at S109, then the density sensor 12 detects the density of a fifth segment formed by the fifth CH voltage (Ve). The detected density is then compared with the reference.

S116: If the density of the fifth segment is poor at S110, the fifth CH voltage is corrected to "(fifth CH voltage)−100 V."

S117: Then, a variety of density corrections are made.

S111: If the density of the segment is good at S110, then the third CH voltage is corrected to "(third CH voltage)+50 V."

S117: Then, a variety of density corrections are made.

As described above, an optimum value of the CH voltage is set by detecting a voltage that is just enough to prevent soiling due to toner-drum potential. This way of setting the CH voltage is advantageous in that only a minimum amount of toner is consumed before an optimum Ch voltage is determined.

Thus, the above-described correction method is effective in preventing soiling due to toner-drum potential due to the deterioration of the photoconductive drum 21, the abnormal charging of the toner, and the poor charging performance of the charging roller 25 caused by the deterioration of the charging roller 25 and deposition of toner on the charging roller 25.

Second Embodiment

A second embodiment prevents soiling due to toner-drum potential by adjusting the supplying voltage SB on the basis of the detection results of soiling due to toner-drum potential and soiling due to oppositely charged toner. An image forming apparatus of the second embodiment is of the same construction as the image forming apparatus 100 of the first embodiment. The second embodiment differs from the first embodiment in an operation where an engine controller 50 makes correction for the SB voltage (i.e., setting of SB voltage for a normal printing operation). Only a portion different from the first embodiment will be described with reference to FIGS. 1-3.

FIG. 12 is a graph illustrating the distribution of potential of the of the toner for different supply voltages SB. Referring to FIG. 12, the SB voltage SB includes five different levels: Vf, Vg, Vh, Vi and Vj according to the density detected in the first embodiment. The distribution of the potential of the toner changes in accordance with the SB voltage. FIG. 12 illustrates the distribution of the potential of the toner, showing only Curve C for the first supply voltage (Vf) and Curve D for the fifth supply voltage (Vj) for simplicity.

When the SB voltage SB is decreased with the developing voltage DB unchanged, the difference in potential between the toner supplying roller 28 and the developing roller 27 decreases. Thus, a smaller amount of negatively charged toner is supplied to the developing roller 27. A decrease in the amount of toner supplied to the developing roller 27 causes a change in the distribution of potential of the toner, so that the area (hatched portion) bounded by the distribution curve becomes smaller. At the same time, the amount of the toner having a higher potential than the surface of the photoconductive drum 21 decreases.

Figure 14A:
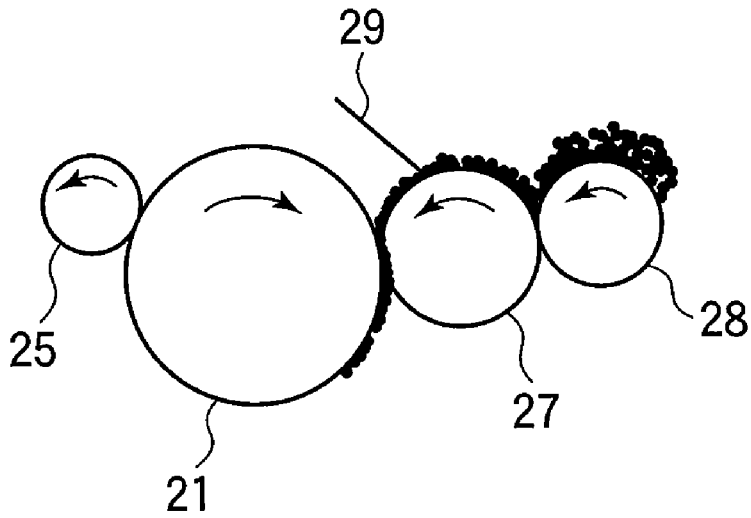
FIGS. 14A and 14B illustrate how the toner is supplied to a developing roller, when the SB voltage is changed while the developing voltage being maintained unchanged.

FIG. 14 illustrates how the toner is supplied to the developing roller 27, when the SB voltage SB is changed with the developing voltage unchanged.

Figure 14B:
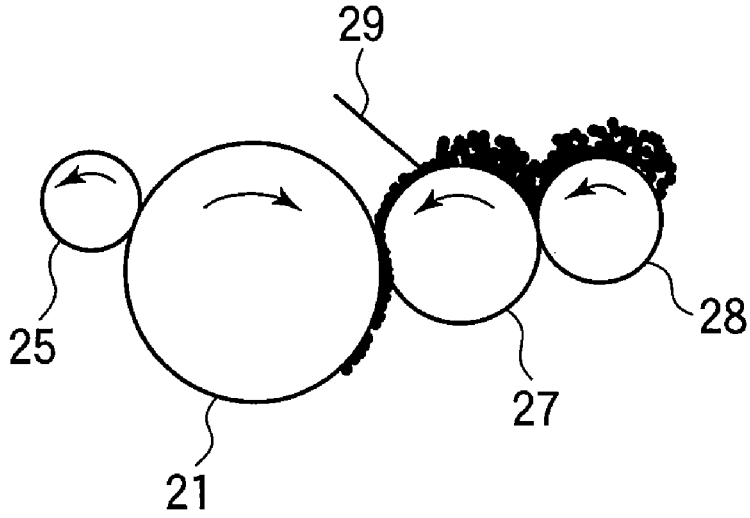

Referring to FIG. 14, the toner is triboelectrically negatively charged by the friction between the developing roller 27 and the supplying roller 28 that rotate in the opposite directions to each other. A high-voltage controller 53 applies a high voltage across the developing roller 27 and the toner supplying roller 28 so that the toner is transferred to the developing roller 27 by the potential difference. A developing blade 29 forms a thin layer of toner on the developing roller 27, and the thin layer of toner is brought into contact with the surface of the photoconductive drum 21 to develop the segments (electrostatic latent image) of a density detection pattern. Thus, when the potential difference between the developing roller 27 and the stoner supplying roller 28 increases as shown in FIG. 14B, the amount of toner supplied to the developing roller 27 increases accordingly. Conversely, when the potential difference between the developing roller 27 and the toner supplying roller 28 decreases as shown in FIG. 4A, the amount of toner supplied to the developing roller 27 decreases accordingly.

As described above, a decrease in SB voltage causes a decrease in the amount of toner charged to a high potential (which causes soiling due to toner-drum potential, decreasing the chance of soiling due to toner-drum potential. This also suggests that a decrease in the amount of oppositely charged toner, decreasing the chance of soiling. A decrease in the SB voltage does not affect the surface potential of the photoconductive drum 21, so that the margin to soiling due to toner-drum potential remains unchanged. A decrease in the SB voltage does not cause a change in the condition which will cause soiling due to toner-drum potential, i.e., the relation between the surface potential of the photoconductive drum 21 and the potential of the oppositely charged toner.

The deterioration of the charging roller 25 and deposition of toner on the charging roller 25 may cause poor charging performance of the charging roller 25. The poor charging performance of the charging roller 25 or the deterioration of the photoconductive drum 21 may cause the absolute value of surface potential of the photoconductive drum 21 to become small even when the same CH voltage is applied to the charging roller 25. Abnormally charged toner will cause the distribution of potential of the toner to shift toward a larger absolute value of potential relative to the surface potential of the photoconductive drum 21. What these two phenomena have in common is that the potential of the toner is higher in absolute value than the potential of the photoconductive drum 21. In order to solve this problem, the absolute value of the SB voltage may be decreased to a level that does not cause soiling due to toner-drum potential.

FIG. 13 is a table illustrating how the correction of the SB voltage is made when the image forming apparatus is determined to be in poor condition (soiling due to toner-drum potential).

Referring to FIG. 13, when the image forming apparatus is determined to be in poor condition at one of five CH voltages (Va to Ve), the SB voltages are corrected by adding a multiple of 20 V to make the absolute value of the SB voltage smaller, i.e., the SB voltage for the fifth CH voltage is increased to "(current SB voltage)+20 V," the SB voltage for the fourth CH voltage is increased to "(current SB voltage)+40 V," the SB voltage for the third CH voltage is increased to "(current supply voltage)+60 V," the SB voltage for the second CH voltage is increased to "(current supply voltage)+80 V," and the SB voltage for the first CH voltage is increased to "(current SB voltage)+100 V." When the image forming apparatus is determined to be in good condition at the five CH voltages Va to Ve, the current SB voltage is maintained.

Figure 15:
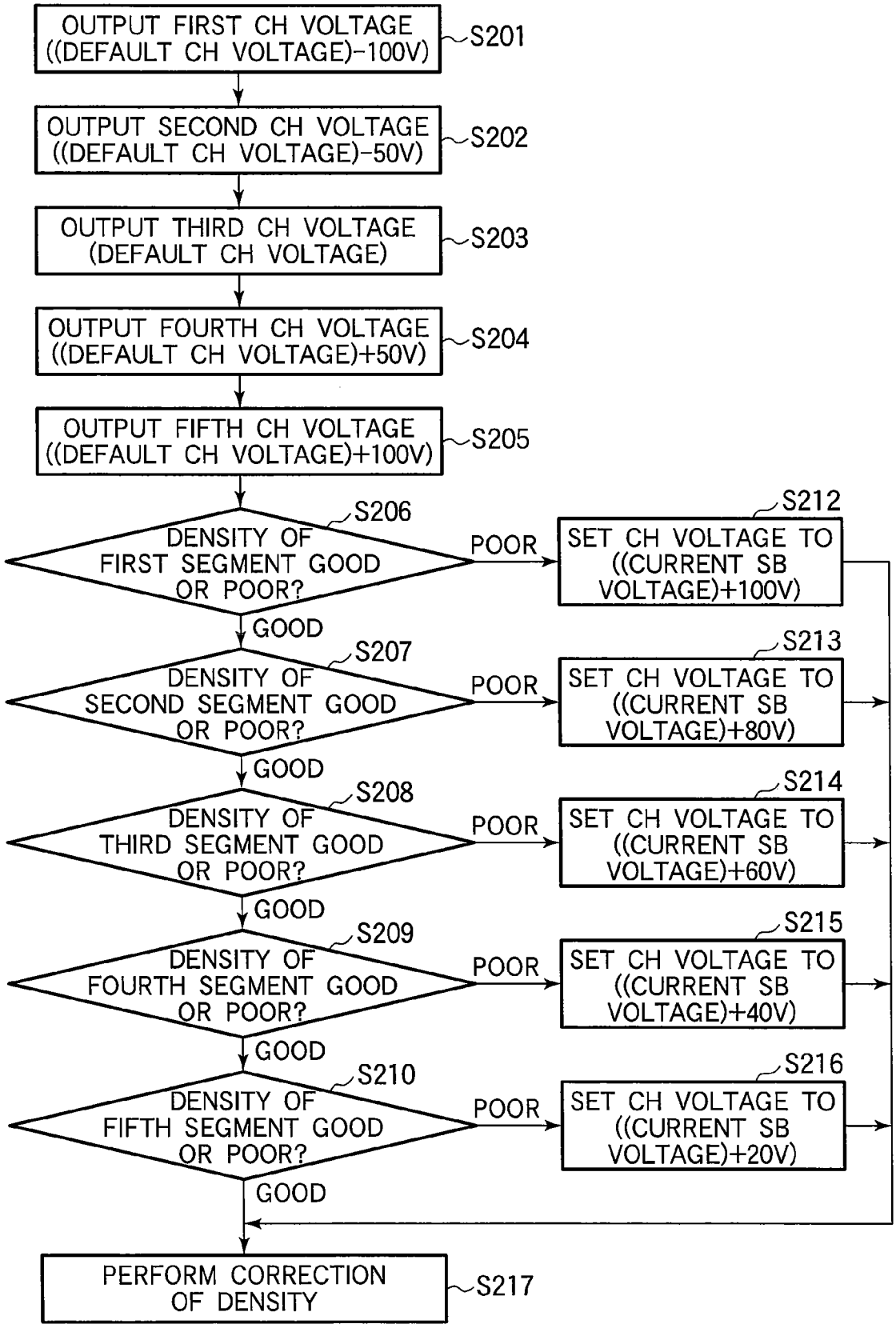
FIG. 15 is a flowchart illustrating the procedure in which the engine controller makes correction of the SB voltage.

FIG. 15 is a flowchart illustrating the procedure in which the engine controller 50 makes correction of the SB voltage. The SB voltage SB is corrected sequentially for the respective image forming sections 16*a* to 16*d*. The procedure is the same for all image forming sections 16*a* to 16*d*. Thus, the following description is common to the image forming sections 16*a* to 16*d*.

S201: The image forming section 16 is ready to print a density detection pattern on the transport belt 9. A first CH voltage (Va), which is equal to "(default CH voltage)−100 V", is applied to the charging roller 25 for a predetermined period of time.

S202: A second CH voltage (Vb), which is equal to "(default CH voltage)−50 V", is applied to the charging roller 25 for a predetermined period of time.

S203: A third CH voltage (Vc), which is equal to "(default CH voltage)", is applied to the charging roller 25 for a predetermined period of time.

S204: A fourth CH voltage (Vd), which is equal to "(default CH voltage)+50 V", is applied to the charging roller 25 for a predetermined period of time.

S205: A fifth CH voltage (Ve), which is equal to "(default CH voltage)+100 V", is applied to the charging roller 25 for a predetermined period of time.

The areas on the photoconductive drum 21 charged by the first to fifth CH voltages, respectively, are brought into contact with the developing roller 27 in sequence, so that the areas are developed with the toner into segments of the density detection pattern. The segments are then transferred onto the transport belt 9 sequentially, so that the density detection pattern having five segments lies on the transport belt 9. As the transport belt 9 runs, the segments of the density detection pattern pass by the density sensor 12.

S206: The density sensor 12 detects the density of the first segment formed by the first CH voltage (Va). The detected density is then compared with the reference.

S212: If the density of the first segment is poor at S206, the SB voltage SB is corrected to "(current SB voltage)+100 V."

S217: Then, a variety of density corrections are made.

S207: If the density of the second segment is good at S206, then the density sensor 12 detects the density of the second segment formed by the second CH voltage (Vb). The detected density is then compared with the reference.

S213: If the density of the second segment is poor at S207, the SB voltage is corrected to "(current SB voltage)+80 V."

S217: Then, a variety of density corrections are made.

S208: If the density of the second segment is good at S207, then the density sensor 12 detects the density of the third segment formed by the third CH voltage (Vc). The detected density is then compared with the reference.

S214: If the density of the third segment is poor at S208, the SB voltage is corrected to "(current SB voltage)+60 V."

S217: Then, a variety of density corrections are made.

S209: If the density of the fourth segment is good at S208, then the density sensor 12 detects the density of the fourth segment formed by the fourth CH voltage (Vd). The detected density is then compared with the reference.

S216: If the density of the fourth segment is poor at S208, the SB voltage is corrected to "(current SB voltage)+40 V."

S217: Then, correction of the SB voltage is made for the next color.

S210: If the density of the fifth segment is good at S209, then the density sensor 12 detects the density of the fifth segment formed by the fifth CH voltage (Vc). The detected density is then compared with the reference.

S216: If the density of the fifth segment is poor at S209, the current SB voltage is corrected to "(current SB voltage)+20 V."

S217: Then, a variety of density corrections are made.

If the density of the fifth segment is good at S210, then the current SB voltage is maintained unchanged.

As described above, the margin for soiling due to toner-drum potential is improved by adjusting the SB voltage in accordance with the degree of soiling due to toner-drum potential. This way of adjusting the SB voltage prevents soiling due to a toner potential exceeding drum potential due to the deterioration of the photoconductive drum 21, the abnormal charging of the toner, and the poor charging performance of the charging roller 25 caused by the deterioration of the charging roller and deposition of toner on the charging roller. In addition, the second embodiment provides an advantage of preventing a decrease in margin for soiling due to oppositely charged toner which would otherwise be caused by setting a higher CH voltage than a current value.

Third Embodiment

Figure 16:
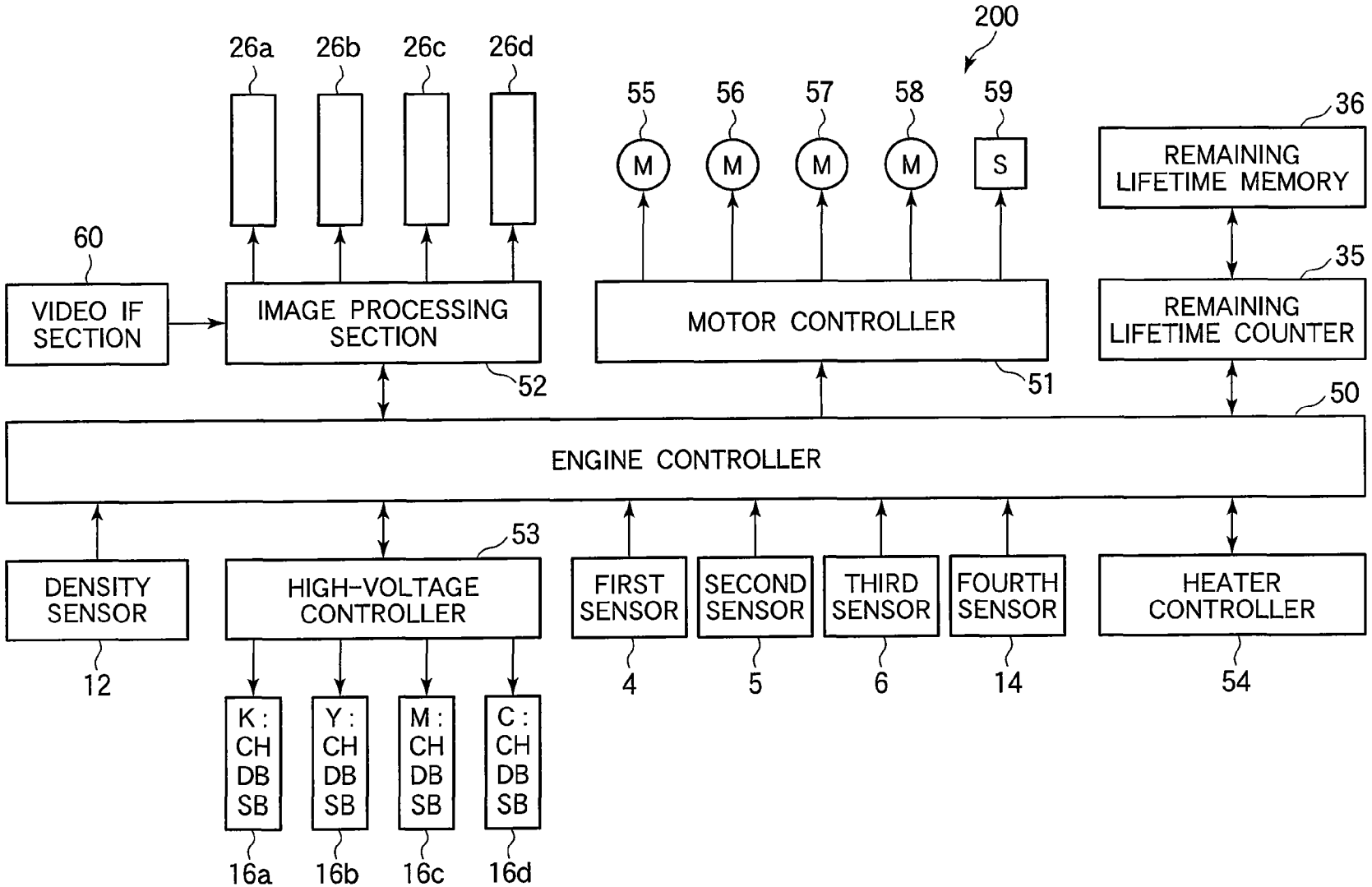
FIG. 16 is a block diagram illustrating a pertinent portion of a controller of a third embodiment.

FIG. 16 is a block diagram illustrating a pertinent portion of a controller of a third embodiment. An image forming apparatus 200 differs from the image forming apparatus 100 (FIG. 3) primarily in that a controller includes a remaining lifetime counter 35 and a remaining lifetime memory 36, and that an engine controller 50 cooperates with the remaining lifetime counter 35 and the remaining lifetime memory 36 in correcting the CH voltage. Elements similar to those of the first embodiment have been given the same reference numerals and their description is omitted. The third embodiment and the first embodiment include the configuration in FIGS. 1 and 2 in common. Thus, the third embodiment will also be described with reference to FIGS. 1 and 2.

Referring to FIG. 16, the remaining lifetime counter 35 counts the remaining lifetime of the respective image forming sections 16, specifically the number of rotations of a photoconductive drum 21. The remaining lifetime memory 36 stores the cumulative number of the rotations of the photoconductive drum 21. The cumulative number of rotations of each photoconductive drum 21 is stored in the remaining lifetime memory 36.

Prior to the correction of the CH voltage, the following operation is performed. The engine controller 50 reads the remaining lifetime count of the respective image forming section from the remaining lifetime memory 36, and compares the lifetime count with a reference stored in a memory (not shown). If the lifetime count is larger than the reference, the procedure in FIG. 11 for correcting the CH voltage is performed. In other words, a detection pattern that includes five segments is formed, and the CH voltage for each color is determined.

Conversely, if the lifetime count is smaller than the reference (i.e., remaining lifetime is long), a detection pattern that includes three segments is formed, and the CH voltage for each color is determined. The method for forming the density detection pattern including three segments will be described.

Figure 17:
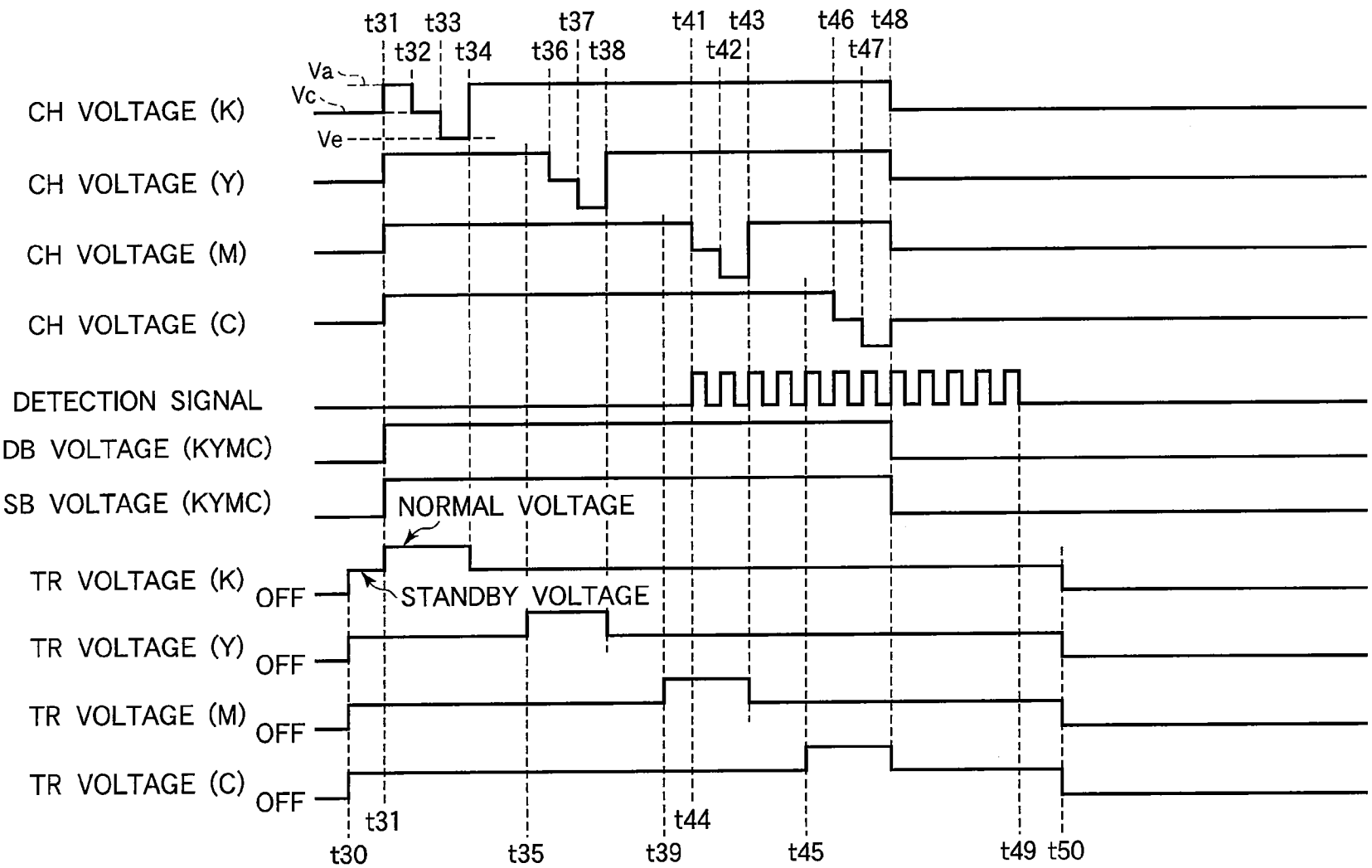
FIG. 17 is a timing chart illustrating changes in various voltages with time when soiling due to toner-drum potential difference and soiling due to oppositely charged toner are detected by the use of a density detection pattern having three different segments.

FIG. 17 is a timing chart illustrating changes in various voltages with time when soiling due to toner-drum potential and soiling due to oppositely charged toner are detected by the use of a density detection pattern having three different segments. The operation of the image forming apparatus 200 for detecting soiling due to toner-drum potential and soiling due to oppositely charged will be described with reference to FIGS. 1, 2 and 16.

In response to a command from the engine controller 50 in FIG. 16, a motor controller 51 drives a belt motor 56 and an ID motor 57 into rotation, so that a transport belt 9 and a photoconductive drum 21 begin to rotate. The rotation of the photoconductive drum 21 is transmitted via a rotation transmitting mechanism (not shown) to the transfer 22, charging roller 25, developing roller 27, and toner supplying roller 28. A high-voltage controller 53 outputs high voltages shown in FIG. 17 in response to a control signal received from the engine controller 50.

The density detection pattern is formed on the transport belt 9 with the LED printhead 26 not energized. In other words, the light emitting diodes of the LED printhead 26 do not illuminate the surface of the photoconductive drum 21, and therefore FIG. 17 does not illustrate the control of the LED printhead 26.

At time t30, the voltages for the four colors (black, yellow, magenta, and cyan) are set to the "OFF state voltage." At time t31, the high-voltage controller 53 outputs a DB voltage to the developing roller 27, an SB voltage to the toner supplying roller 28, and a CH voltage to the charging roller 25. The CH voltage is a first CH voltage Va, a maximum value, at time t31, and then decreases stepwise.

The density detection patterns of the respective colors are printed in sequence beginning from the black image forming section (K) 16*a*. The high-voltage controller 53 applies the first to fifth CH voltages to the charging roller 25*a* in sequence: the first CH voltage Va at time t31, a third CH voltage Vc at time t32, and a fifth CH voltage Ve at time t33, and again the first CH voltage Va at time t34. The areas on the surface of the photoconductive drum 21*a* charged by the first to fourth CH voltages are brought into contact with the developing roller 27 as the photoconductive drum 21*a* rotates such that the charged areas are developed with the toner into a toner detection pattern as a whole. The toner detection pattern is then transferred onto the transport belt 9 as a density detection pattern.

The duration of the first, third, and fifth CH voltages is selected by taking the transport speed of the transport belt 9, the ability of the density sensor 12 to detect the density, and processing speed of the engine controller 50 into account. The duration should be sufficiently long so that the density detection pattern may be read accurately from the transport belt 9 running at a predetermined transport speed. The duration should also be sufficiently long so that the density detection pattern may be read optically and converted into an analog voltage signal. Further, the duration should be sufficiently long so that an A/D converter accurately samples the analog voltage signal into a digital signal and the controller 50 may process the digital signal accurately. In order to process the signals in a short time and use a minimum amount of toner, the duration of the first, third, and fifth CH voltages should be as short as possible provided that the aforementioned conditions are met.

In the embodiment, the third CH voltage Vc is assumed to be a median such that the CH voltages Va is directly above Vc and Vd is directly below Vc. The size of increment and decrement should be selected in accordance with the characteristics of the image forming apparatus. An empirical size of 100 volts has been found sufficiently small in determining an optimum CH voltage.

Referring to FIG. 17, the CH voltage decreases in three steps. As described above, a density detection pattern having three segments is printed on the transport belt 9 by applying the CH voltage in an increment of 100 volts. The DB voltage and SB voltage are applied in synchronism with the CH voltage. At time t31, a TR voltage (transfer voltage) is also applied to the transfer roller 22*a* in synchronism with the CH voltage, DB voltage and SB voltage, thereby transferring the density detection pattern from the photoconductive drum 21*a* onto the transport belt 9.

Three segments of the density detection pattern are formed during a period of times t31-t34. Likewise, the CH voltage for image forming section 16*b* is applied to the charging roller 25 that changes stepwise at times t35-t38 to form a density detection pattern of yellow on the photoconductive drum 21*b*. The CH voltage for image forming section 16*c* is applied to the charging roller 25 that changes stepwise at times t39-t43 to form a density detection pattern of yellow on the photoconductive drum 21*c*. The CH voltage for image forming section 16*d* is applied to the charging roller 25 that changes stepwise at times t45-t48 to form a density detection pattern of yellow on the photoconductive drum 21*d*. The density detection patterns for yellow, magenta, and cyan are transferred onto the transport belt 9 at similar timings to the density detection pattern for black.

The areas on the photoconductive drum 21 charged by different CH voltages (i.e., segments of the density detection pattern) reach a transfer point defined between the transfer roller 22 and the photoconductive drum 21 at timings displaced by a predetermined period of time. For simplicity, the displacement in time is not shown in FIG. 17.

The leading end of the density detection pattern for black printed on the transport belt 9 reaches the density sensor 12 at time t44. The density sensor 12 detects the density of the respective segments of the density detection pattern for black, and provides a detection output to the engine controller 50, the detection output including the densities of the segments aligned in the order of Va, Vc, and Ve.

The deterioration of the charging roller 25 and deposition of toner on the charging roller 25 may cause poor charging performance of the charging roller 25. The poor charging performance of the charging roller 25, the deterioration of the photoconductive drum 21, and the abnormal charging of the toner cause serious damage to the image forming apparatus. As a result, a segment closer to the segment formed by the fifth CH voltage (Ve) tends to have a density exceeding a reference level. An image forming apparatus in good condition, i.e., free from serious damage, may have satisfactory densities at the first, third, and fifth CH voltages, which will be described later with reference to FIGS. 19 and 20.

The reference level is previously stored in a memory means (not shown) within the engine controller 50 (FIG. 3). Prior to comparison of the detection output of the density sensor 12 with the reference level, the reference level is read from the memory means.

Figure 18:
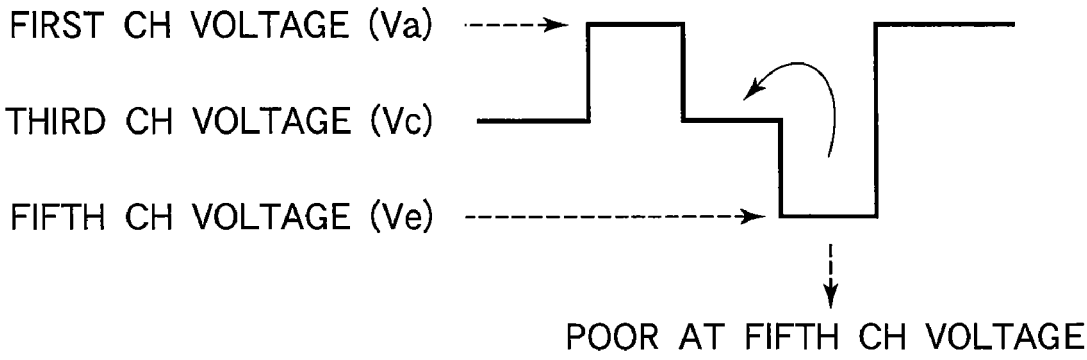
FIG. 18 illustrates the method when it is determined that the image forming apparatus has been soiled.

A description will be given of a method for correcting the CH voltage based on the comparison of the detection output of the density sensor 12 with the reference level. FIG. 18 illustrates the method when it is determined that the image forming apparatus has been soiled due to toner-drum potential or oppositely charged toner.

Referring to FIG. 18, assume that the image forming apparatus is determined to have suffered from soiling due to toner-drum potential at the fifth CH voltage (Ve). One simple way of correcting the CH voltage is to simply set the CH voltage to a voltage having an absolute value larger than the fifth CH voltage by 100 volts such that the CH voltage has a margin of 100 V against soiling due to toner-drum potential.

Figure 19:
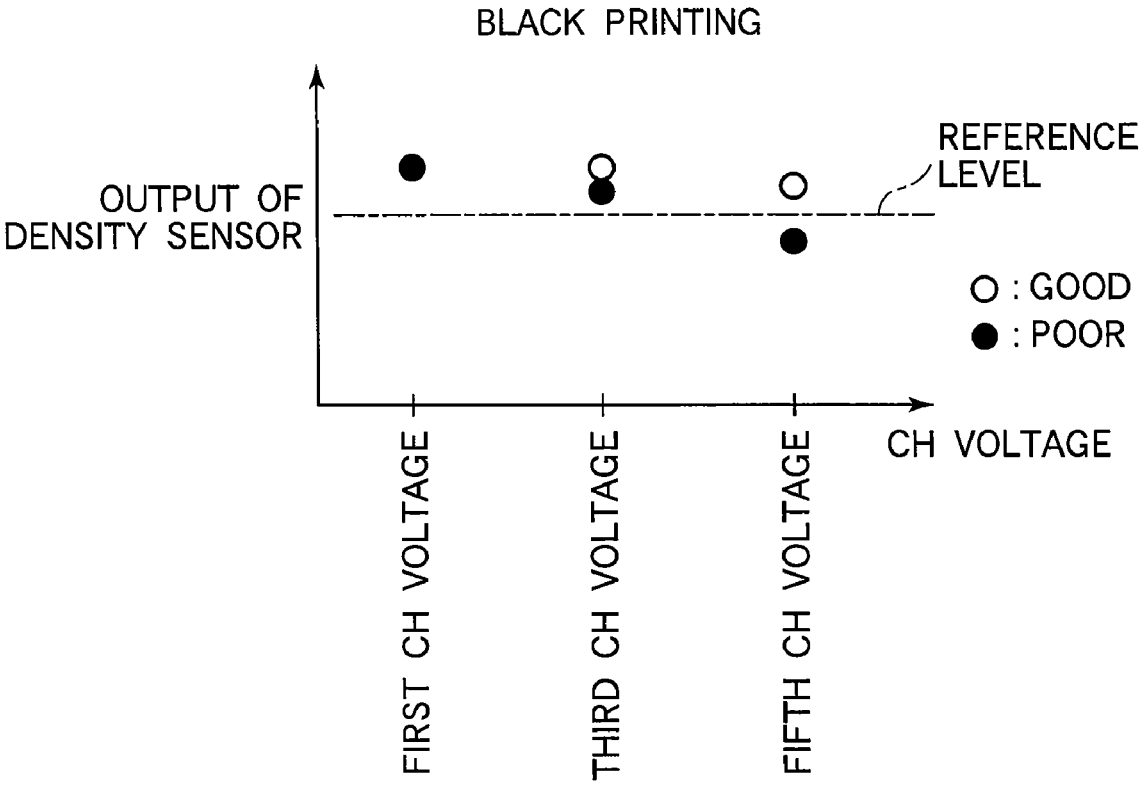
FIG. 19 illustrates the detection output of a density sensor when a black density detection pattern is tested by using an image forming apparatus that has been soiled and an image forming apparatus that has not been soiled.
Figures 20, 21:
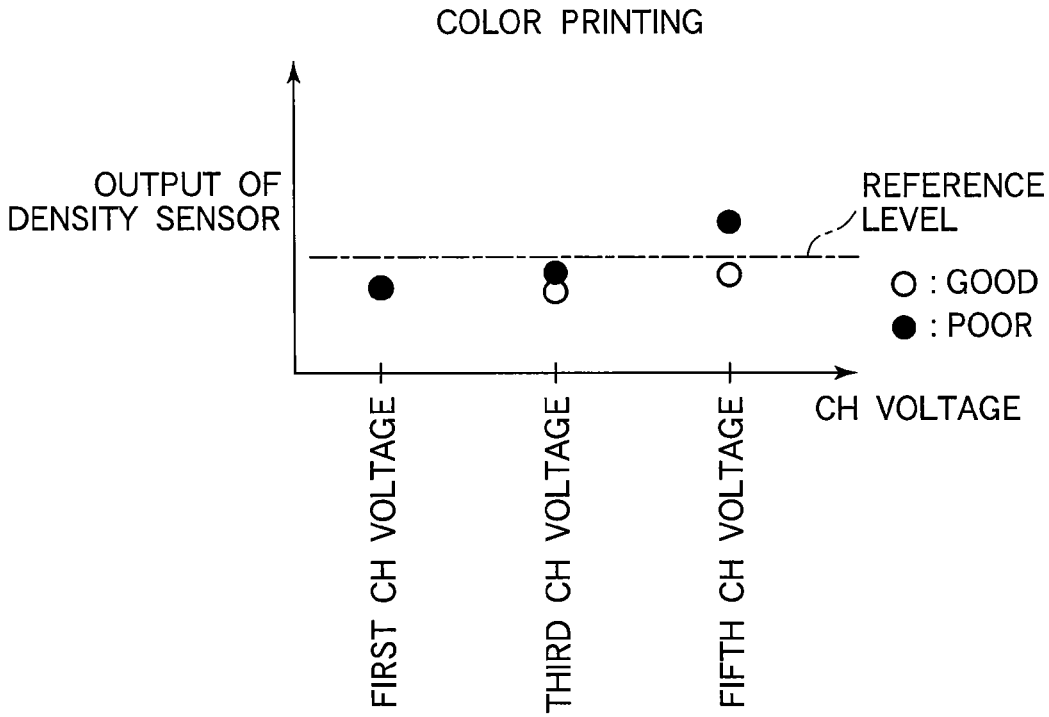
FIG. 20 illustrates the detection output of the density sensor when a color density detection pattern is tested using an image forming apparatus that has been soiled and an image forming apparatus that has not been soiled.
FIG. 21 is a table illustrating how the correction for the CH voltage is made when the image forming apparatus is determined to be in poor condition (soiled)

FIG. 19 illustrates the detection output of a density sensor 12 when a black density detection pattern is tested by using an image forming apparatus that has been soiled and an image forming apparatus that has not been soiled. FIG. 20 illustrates the detection output of the density sensor 12 when a color density detection pattern is tested using an image forming apparatus that has been soiled and an image forming apparatus that has not been soiled.

Referring to FIG. 19, for black printing, densities above the reference level are good. If the densities at five CH voltages are above the reference level, then the image forming apparatus is in good condition (not soiled). If at least one of five CH voltages is below the reference level, then the image forming apparatus is in poor condition (soiled).

Referring to FIG. 20, for color printing, densities below the reference level are good. If the densities at five CH voltages are below the reference level, then the image forming apparatus is in good condition (not soiled). If at least one of five CH voltages is above the reference level, then the image forming apparatus is in poor condition (soiled).

FIG. 21 is a table illustrating how the correction for the CH voltage (CH voltage used for normal printing) is made when the image forming apparatus is determined to be in poor condition (soiled).

Referring to FIG. 21, when the image forming apparatus is determined to be in poor condition at one of the first, third, and fifth CH voltages (Va, Vc, Ve), the CH voltage that caused a poor condition is increased by 100 volts (absolute value). If the image forming apparatus is determined to be in good condition at the first, third, and fifth CH voltages (Va, Vc, Ve), the CH voltage is set to a smaller value (absolute value), i.e., to "(third CH voltage)+50 V".

Figure 22:
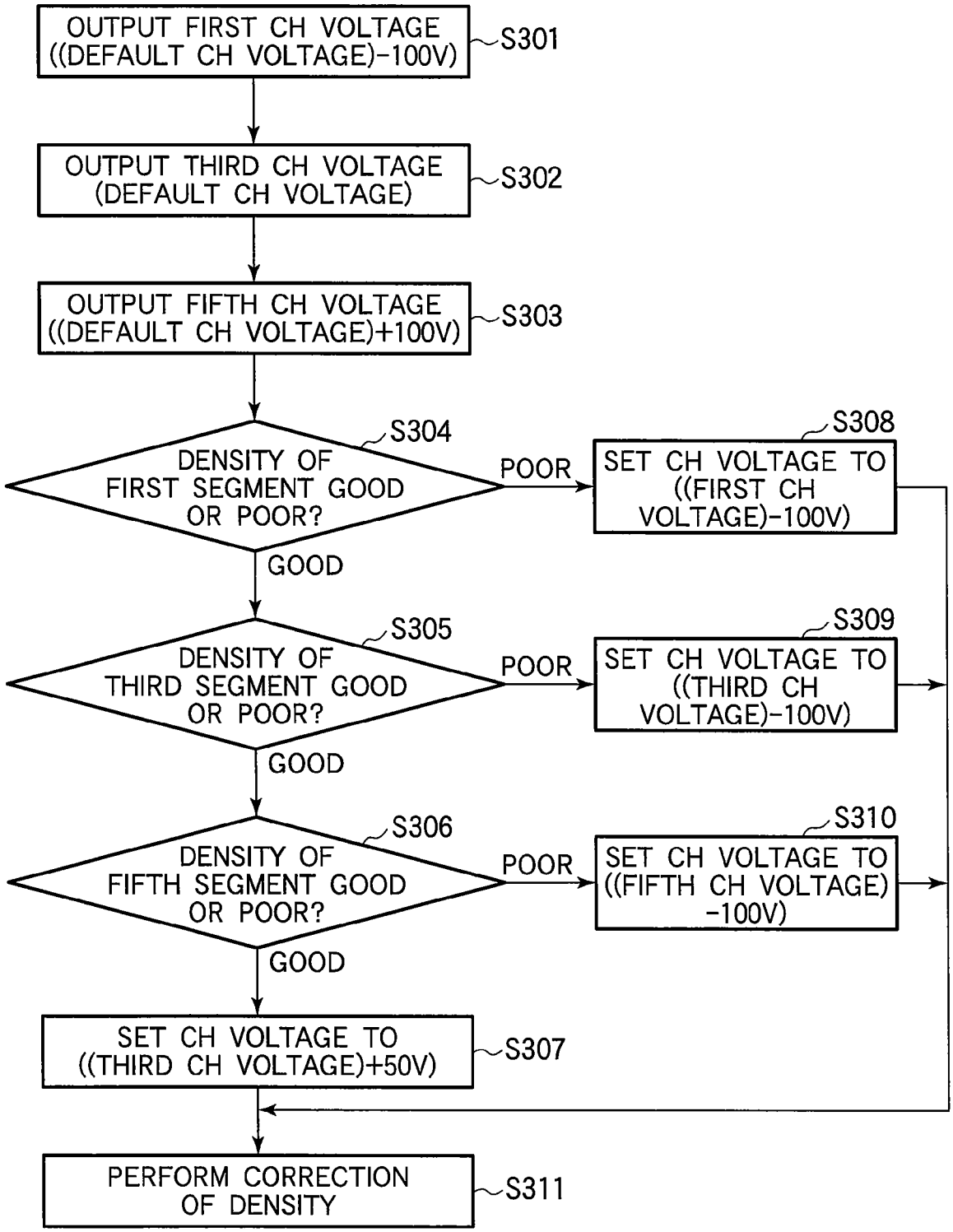
FIG. 22 is a flowchart illustrating the procedure in which the CH voltage is corrected by the engine controller.

FIG. 22 is a flowchart illustrating the procedure in which the CH voltage is corrected by the engine controller 50. The CH voltage is corrected sequentially for the respective image forming sections 16*a* to 16*d*. The procedure is the same for all image forming sections 16*a* to 16*d*. Thus, the following description is common to the image forming sections 16*a* to 16*d*.

S301: The image forming section 16 is ready to form a density detection pattern on the transport belt 9. A first CH voltage (Va), which is equal to "(default CH voltage)−100 V", is applied to the charging roller 25 (FIG. 2) for a predetermined period of time.

S302: A third CH voltage (Vc), which is equal to "(default CH voltage)−50 V", is applied to the charging roller 25 for a predetermined period of time.

S303: A fifth CH voltage (Ve) is applied to the charging roller 25 for a predetermined period of time.

The areas on the photoconductive drum 21 charged by the first, third, and fifth CH voltages, respectively, are brought into contact with the developing roller 27 in sequence, so that the areas are developed with the toner into the first, third, and fifth segments of the density detection pattern. The segments are then transferred onto the transport belt 9 sequentially, so that the density detection pattern having the first, third, and fifth segments lies on the transport belt 9. As the transport belt 9 runs, the segments of the density detection pattern passes by the density sensor 12.

S304: The density sensor 12 detects the density of the first segment formed by the first CH voltage (Va). The detected density is then compared with the reference.

S308: If the density of the first segment is poor at S304, the CH voltage is set to a value of "(first CH voltage)−100 V."

S311: Then, a variety of density corrections are made.

S305: If the density of the first segment is good at S304, then the density sensor 12 detects the density of the third segment formed by the third CH voltage (Vc). The detected density is then compared with the reference.

S309: If the density of the third segment is poor at S305, the CH voltage is set to a value of "(third CH voltage)−100 V."

S311: Then, a variety of density corrections are made.

S306: If the density of the third segment is good at S305, then the density sensor 12 detects the density of the fifth segment formed by the fifth CH voltage (Ve). The detected density is then compared with the reference.

S310: If the density of the fifth segment is poor at S306, the CH voltage is set to a value of "(fifth CH voltage)−100 V."

S311: Then, a variety of density corrections are made.

S307: If the density of the fifth segment is good at S306, then the CH voltage is set to a value of "(third CH voltage)+50 V."

S311: Then, a variety of density corrections are made.

As described above, the number of segments in a density detection pattern is changed in accordance with the lifetime count of the image forming section 21. When an image forming apparatus has a long remaining lifetime, a density detection pattern having a smaller number of segments may be employed in order to shorten the total amount of time for correcting the CH voltage. While the third embodiment has been described with respect to a case where the number of segments is switched from 3 to 5, any number of segments may be used as long as the density detection pattern is switched from a density detection pattern having a smaller number of segments to a density detection pattern having a larger number of segments.

The difference between the first CH voltage (Va) and the fifth CH voltage (Ve) is 200 V, which is the same as that for the first and second embodiments. If an image forming section 16 is apt to cause soiling due to toner-drum potential in a specific range of CH voltage for a remaining lifetime, then the first to fifth CH voltage may be shifted into the range such that the third CH voltage (median) is in the middle of the range. Alternatively, the first and the fifth CH voltages may be set at a high end and a low end of the range, respectively. While the density detection pattern is switched from a 3-segment pattern to a 5-segment pattern at a single specific life time count, number of segments may also be changed at a plurality of lifetime counts stepwise.

Although the embodiment has been described with respect to a case in which the number of segments is switched in accordance with the lifetime count of the image forming section 16, the invention is not limited to this. For example, the number of segments or CH voltages may be switched (e.g., 3 to 5) based on the lifetime count of the image forming section 16 through the procedure described in the second embodiment.

As described above, the third embodiment provides the same advantages as the first and second embodiments. The number of segments of a density detection pattern may be changed in accordance with the lifetime count of the image forming section 16. Thus, the time required for correcting the CH voltage may be shorter when the image forming section has a long remaining usable life than when the image forming section has a short remaining usable life.

Fourth Embodiment

Figure 23:
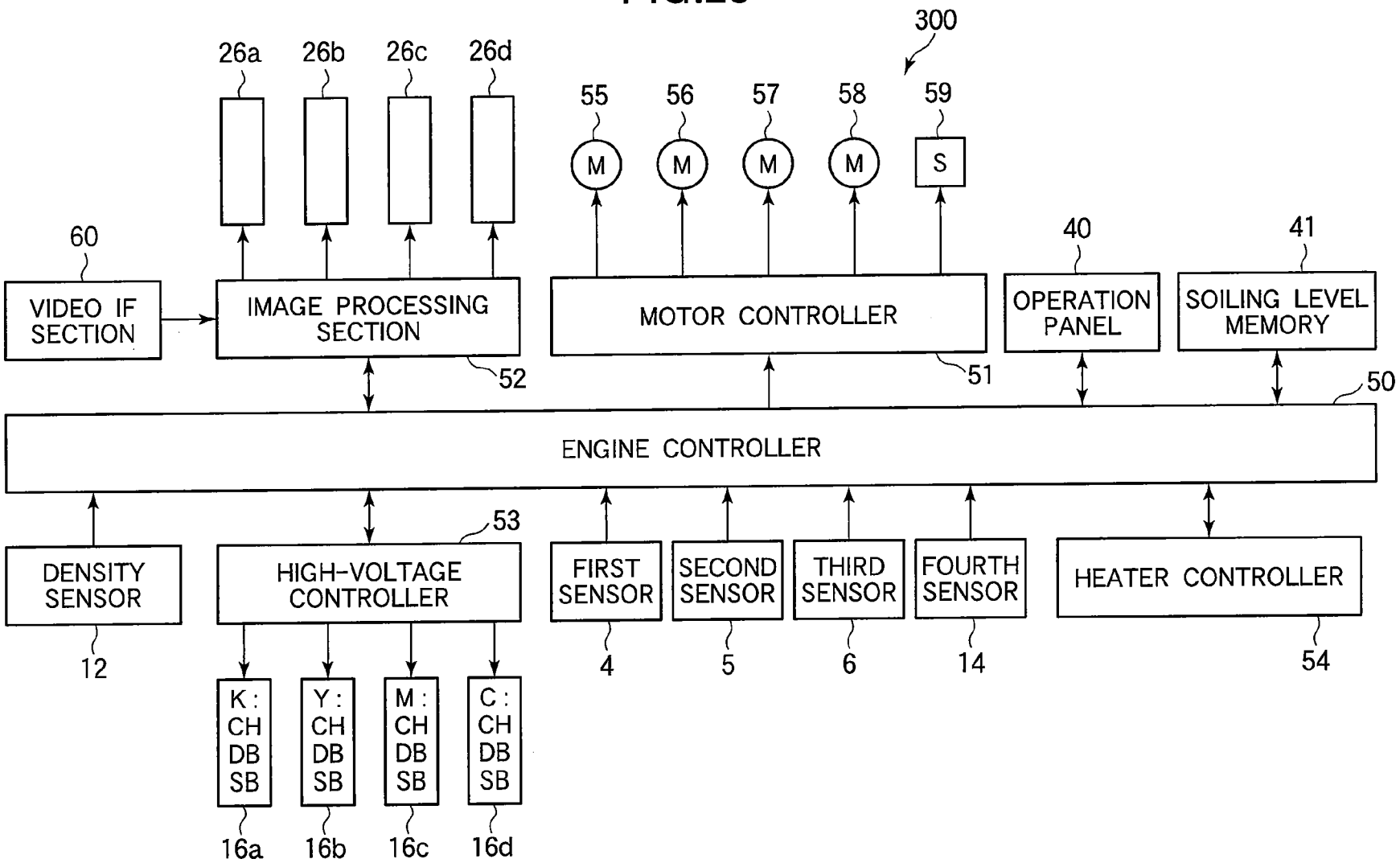
FIG. 23 is a block diagram illustrating a pertinent portion of a controller of a fourth embodiment.

FIG. 23 is a block diagram illustrating a pertinent portion of a controller of a fourth embodiment. An image forming apparatus 300 differs from the image forming apparatus 100 (FIG. 3) primarily in that the controller further includes an operation panel 40 and a soiling level memory 41, and that an engine controller 50 cooperates with the operation panel 40 and the engine controller 50. Elements similar to those of the first embodiment have been given the same reference numerals and their description is omitted. The fourth embodiment and the first embodiment include a configuration in FIGS. 1 and 2 in common. Thus, the fourth embodiment will also be described with reference to FIGS. 1 and 2.

The operation of the fourth embodiment differs from that of the third embodiment as follows: The number of segments of a density detection pattern of the third embodiment is set based on the lifetime count of the respective image forming section 16 (FIG. 1) while the number of segments of a density detection pattern of the fourth embodiment is set based on the soiling level detected last time.

The method for detecting the level of soiling will be described with reference to FIGS. 24-30.

Figures 24, 25:
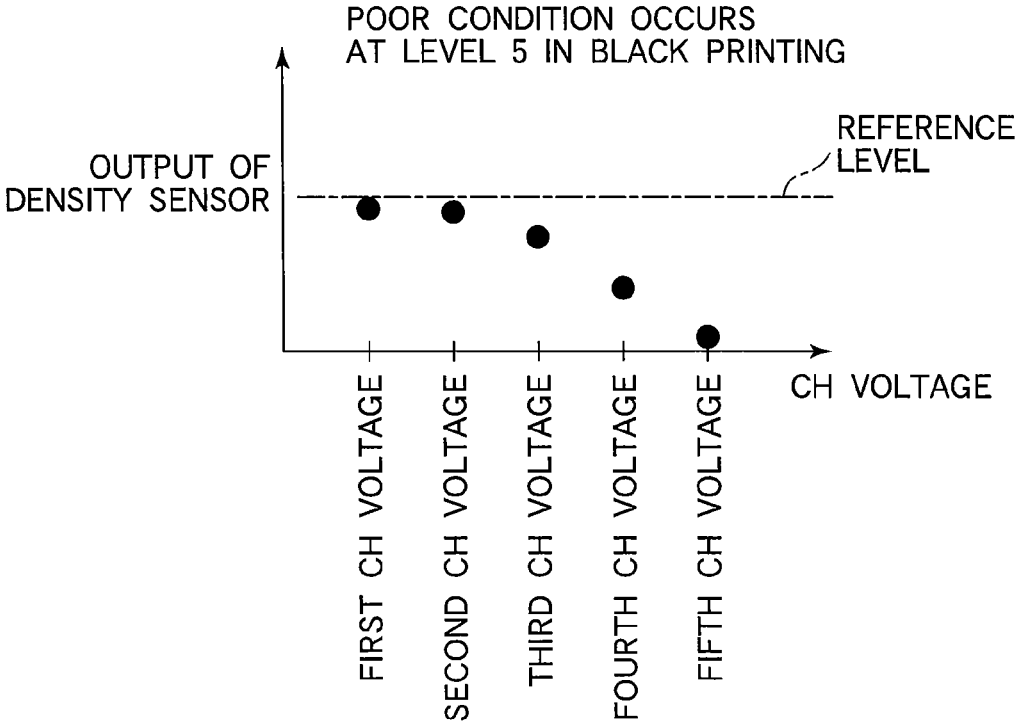
FIG. 24 is a table illustrating CH voltages and a corresponding soiling level.
FIG. 25 illustrates a case in which the first to fifth segments of the density detection pattern are determined to be poor.

FIG. 24 is a table illustrating CH voltages (Va to Ve) and a corresponding soiling level (levels 5 to 0). The method for forming a density detection pattern and determining whether the image forming apparatus is in good condition or poor condition is the same as in the first embodiment, and the description thereof is omitted.

Figure 26:
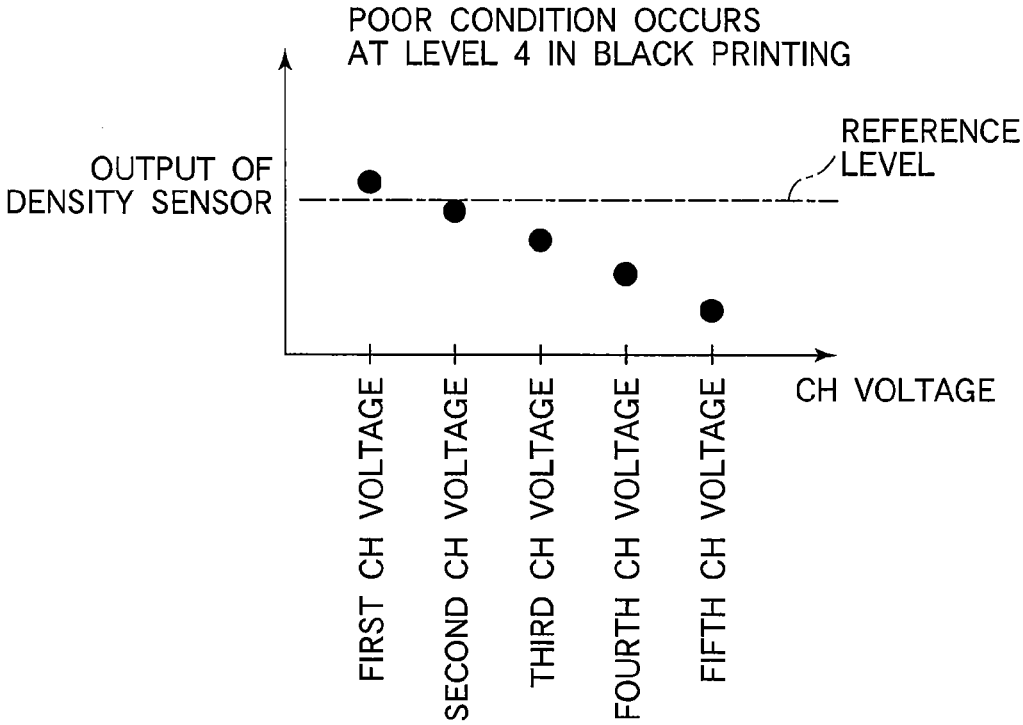
FIG. 26 illustrates a case in which the second to fifth segments of the density detection pattern are determined to be poor.

FIGS. 25-30 assume that a black density detection pattern is printed. FIG. 25 illustrates a case in which the first to fifth segments of the density detection pattern are determined to be poor. Referring to FIG. 25, none of the detection outputs of the density sensor 12 is higher than a reference density level (i.e., all of the segments of the density detection pattern are poor), indicating soiling level "5". FIG. 26 illustrates a case in which the second to fifth segments of the density detection pattern are determined to be poor. Only the detection output of the first segment the density sensor 12 is not lower than a reference density level (i.e., only the first segment of the density detection pattern is good), indicating soiling level "4".

Figure 27:
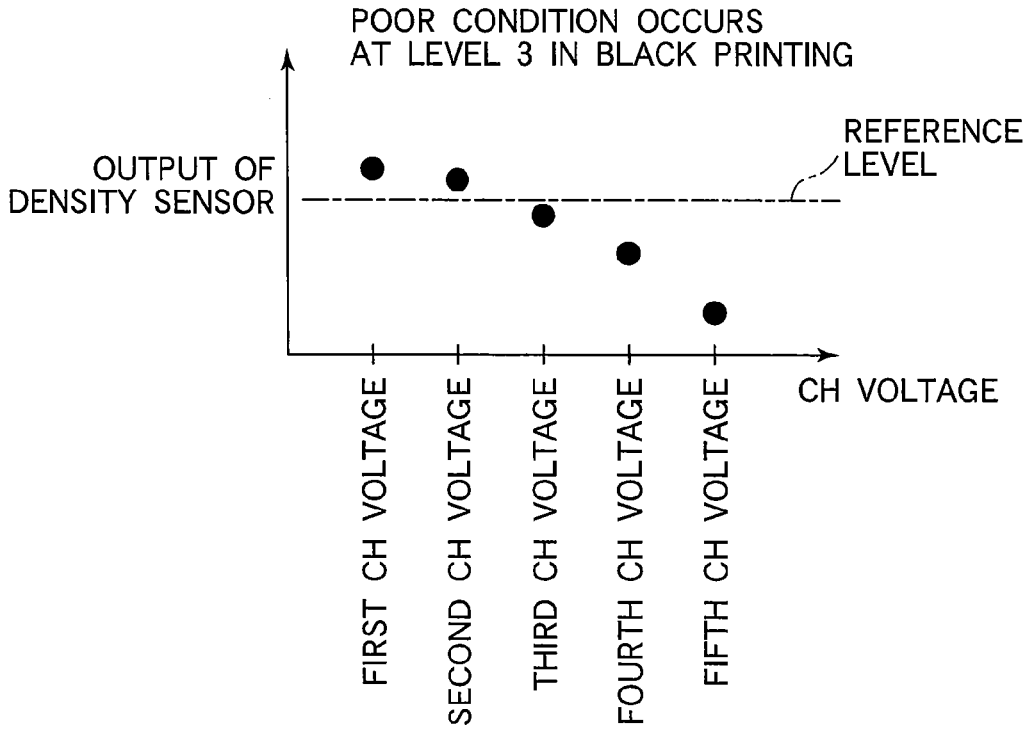
FIG. 27 illustrates a case in which the third to fifth segments of the density detection pattern are determined to be poor, indicating soiling level "3"
Figure 28:
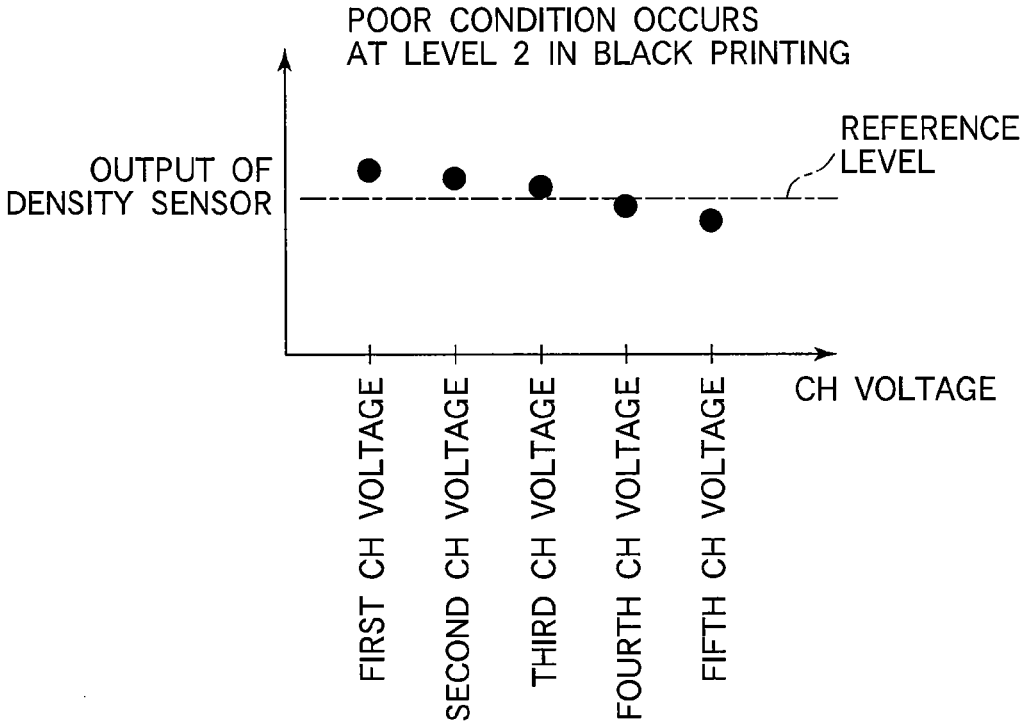
FIG. 28 illustrates a case in which the fourth and fifth segments of the density detection pattern are determined to be poor, indicating soiling level "2"
Figure 29:
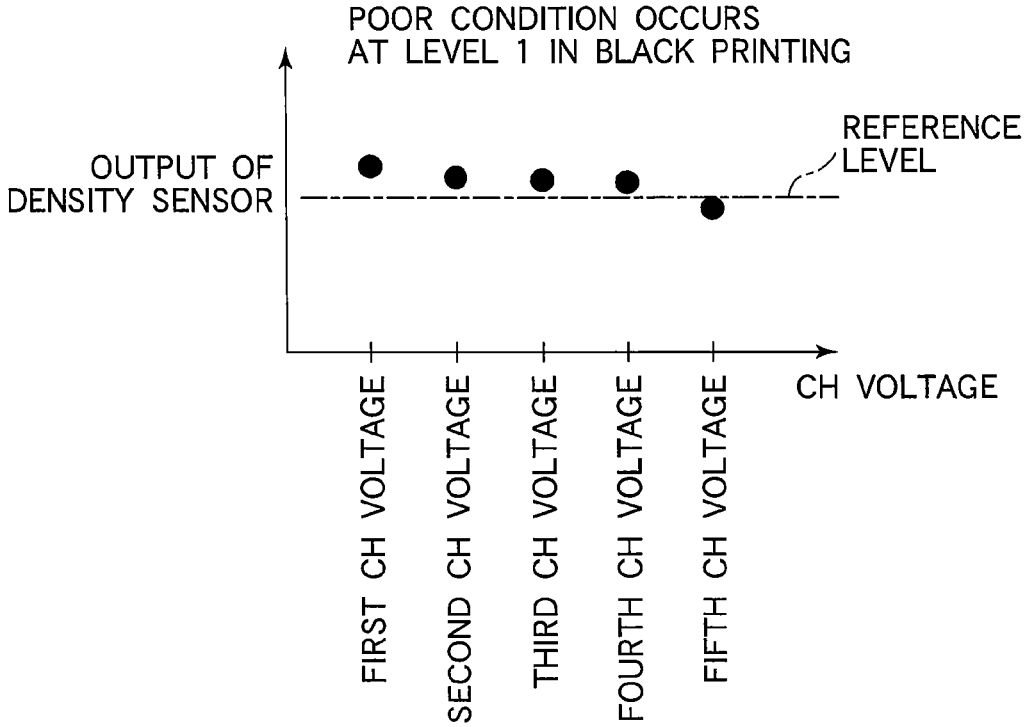
FIG. 29 illustrates a case in which only the fifth segment of the density detection pattern is determined to be poor, indicating soiling level "1"
Figure 30:
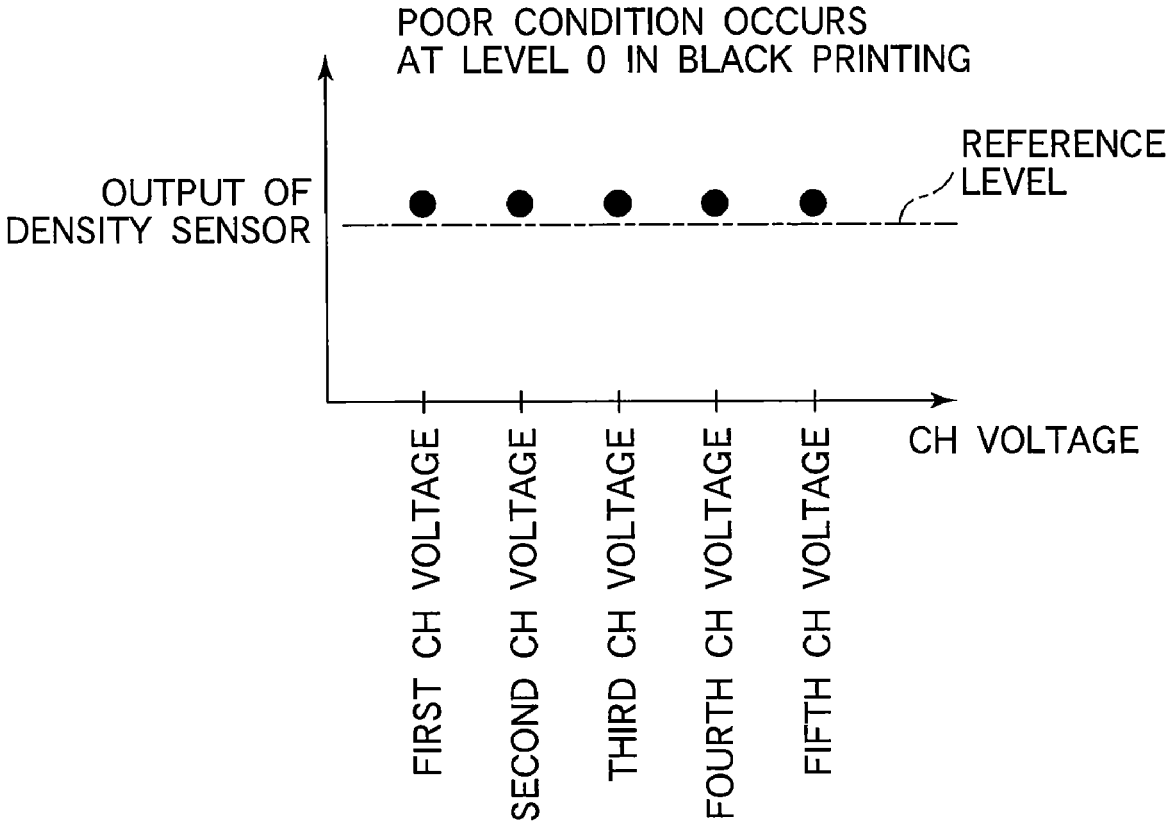
FIG. 30 illustrates a case in which none of the segments of the density detection pattern is determined to be poor, indicating soiling level "0"

Likewise, FIG. 27 illustrates a case in which the third to fifth segments of the density detection pattern are determined to be poor, indicating soiling level "3", and FIG. 28 illustrates a case in which the fourth and fifth segments of the density detection pattern are determined to be poor, indicating soiling level "2." FIG. 29 illustrates a case in which only the fifth segment of the density detection pattern is determined to be poor, indicating soiling level "1." FIG. 30 illustrates a case in which none of the segments of the density detection pattern is determined to be poor, indicating soiling level "0," i.e., no soiling occurs.

In the fourth embodiment, when the soiling level is equal to or larger than "3," correction of the CH voltage is made using a density detection pattern having five segments as described in the first embodiment. When the soiling level is smaller than "3," correction of the CH voltage is made using a density detection pattern having three segments as described in the third embodiment. The detected soiling level is stored into the soiling level memory 41 in the form of a non-volatile memory, so that the soiling level is not lost when the image forming apparatus 300 is turned off.

Figure 31:
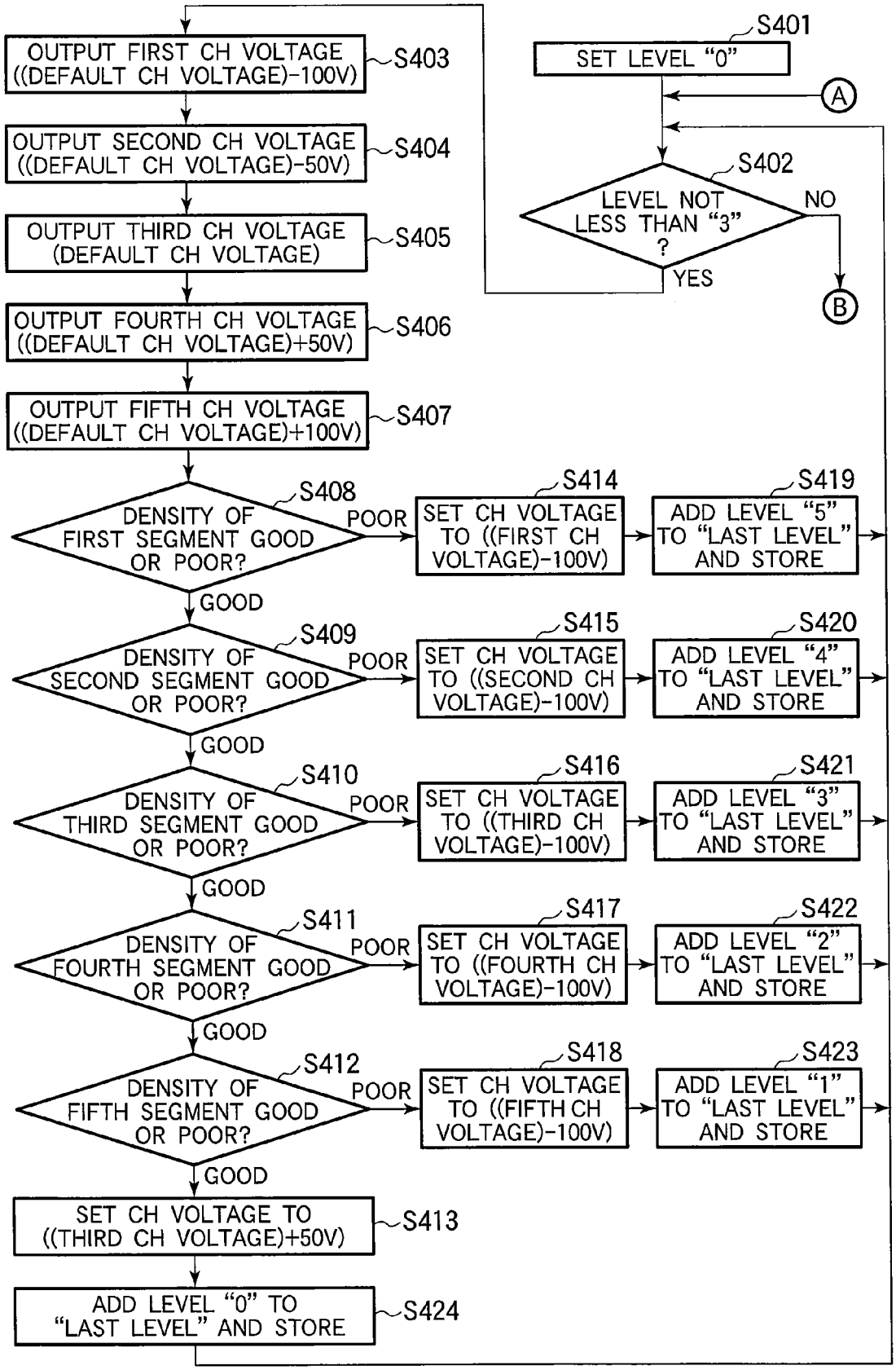
FIG. 31 is an initial portion of a flowchart illustrating the procedure for correcting the CH voltage performed in the engine controller.
Figure 32:
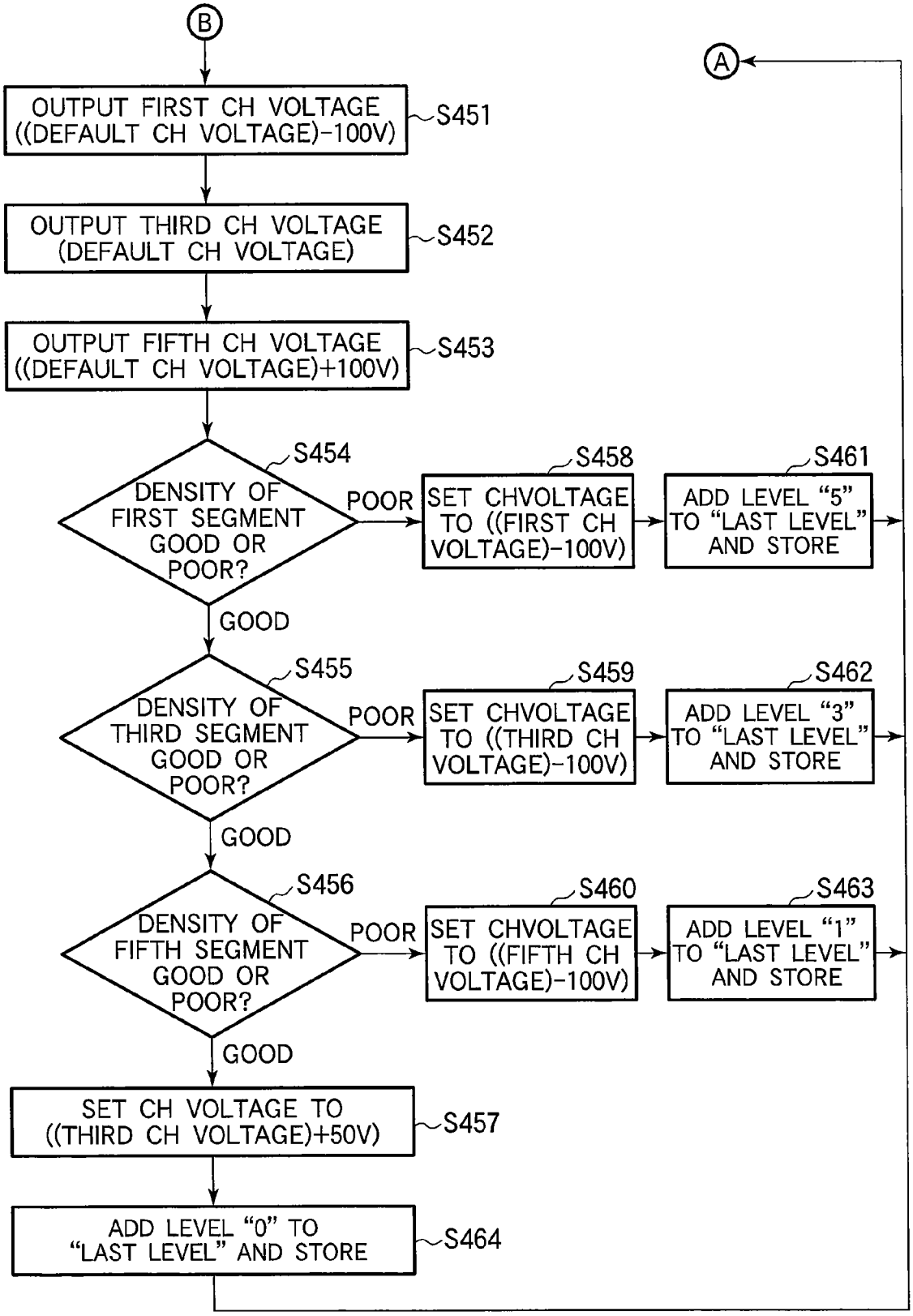
FIG. 32 is an additional portion of the flowchart.

FIG. 31 is an initial portion of a flowchart illustrating the procedure for correcting the CH voltage (i.e., setting of the CH voltage for a normal printing operation), performed in the engine controller 50, and FIG. 32 is an additional portion of the flowchart. The correction of the CH voltage is made sequentially for the respective image forming sections 16*a* to 16*d*. The procedure is the same for the image forming sections 16*a* to 16*d*. Thus, the following description is common to the image forming sections 16*a* to 16*d*.

S401: Correction of the CH voltage is initiated. The soiling level "0" has been previously stored as an initial value in the soiling level memory 41.

S402: A check is made to determine whether the soiling level in the soiling level memory 41 is not smaller than "3". An image forming apparatus has a long remaining lifetime and therefore has a smaller soiling level. If the soiling level in the soiling level memory 41 is small than "3," the program proceeds to S451 (FIG. 32.) The operation performed at S451-460 is the same as that of S301-310 (FIG. 22), and correction of the CH voltage is made using a density detection pattern having three segments.

S461: If the density of the first segment of the density detection pattern is not larger than the reference density level (POOR at S454), the detected density level (i.e., soiling level "5") is added to the last value (here, "0"), and the sum is stored into the soiling level memory 41.

S462: If the density of the third segment of the density detection pattern is not larger than the reference density level (POOR at S455), the detected density level (i.e., soiling level "3") is added to the last value (here, "0"), and the sum is stored into the soiling level memory 41.

S463: If the density of the fifth segment of the density detection pattern is not larger than the reference density level (POOR at S456), the detected density level (i.e., soiling level "1") is added to the last value (here, "0"), and the sum is stored into the soiling level memory 41.

In the fourth embodiment, a maximum level of the soiling level is "5," and therefore if a result of addition is larger than "5," then the soiling level is set to "5."

As described above, once the CH voltage and the soiling level have been set, the program returns to S402 for correcting the CH voltage for the next correction.

If it is determined that the soiling level is smaller than "3" at S402, then the program proceeds to S403. The operation performed at S403-418 is the same as that of S101-116 (FIG. 11), and correction of the CH voltage is made using a density detection pattern having five segments.

S419: If the density of the first segment of the density detection pattern is not larger than the reference density level (POOR at S408), the detected density level (i.e., soiling level "5") is added to the last value (here, "0"), and the sum is stored into the soiling level memory 41.

S420: If the density of the second segment of the density detection pattern is not larger than the reference density level (POOR at S409), the detected density level (i.e., soiling level "4") is added to the last value (here, "0"), and the sum is stored into the soiling level memory 41.

S421: If the density of the third segment of the density detection pattern is not larger than the reference density level (POOR at S410), the detected density level (i.e., soiling level "3") is added to the last value (here, "0"), and the sum is stored into the soiling level memory 41.

S422: If the density of the fourth segment of the density detection pattern is not larger than the reference density level (POOR at S411), the detected density level (i.e., soiling level "2") is added to the last value (here, "0"), and the sum is stored into the soiling level memory 41.

S423: If the density of the fifth segment of the density detection pattern is not larger than the reference density level (POOR at S412), the detected density level (i.e., soiling level "1") is added to the last value (here, "0"), and the sum is stored into the soiling level memory 41.

S424: If the fifth segment of the density detection pattern is not smaller than the reference density level (Y at S412), the detected density level (i.e., soiling level "0") is added to the last value (here, "0") in the soiling level memory 41.

In the fourth embodiment, a maximum level of the soiling level is "5," and therefore if a result of addition is larger than "5," then the soiling level is set to "5."

As described above, once the CH voltage and the soiling level have been set, the program returns to S402 for correcting the CH voltage for the next correction.

The detected soiling level may be read from the soiling level memory 41 via the operation panel 40, displayed to the user, and printed out for maintenance purpose. In other words, the soiling level may be used as data for maintenance service and as information on the image forming apparatus.

As described above, the fourth embodiment provides the same advantages as the first and second embodiments. The number of segments of a density detection pattern may be changed in accordance with the soiling level. As a result, regardless of whether the remaining lifetime of the image forming apparatus is long or short, the soiling level is detected in more detail if the image forming apparatus has a short remaining lifetime while the soiling level is detected in less detail if the image forming apparatus has a long remaining lifetime. In this manner, the time required for a variety of corrections including the CH voltage may be shortened depending on the remaining lifetime of the image forming apparatus.

Fifth Embodiment

The areas on the photoconductive drum 21 are charged by the first to fifth CH voltages Va, Vb, Vc, Vd, and Ve, respectively, and are then sequentially brought into contact with the developing roller 27, so that the areas are developed with the toner into segments of a density detection pattern. The segments are then transferred onto the transport belt 9 sequentially so that the density detection pattern having five segments lies on the transport belt 9. As the transport belt 9 runs, the segments of the density detection pattern pass by the density sensor 12, and are detected by a density sensor 12. In the fifth embodiment, shortly after a segment is formed using the corresponding one of the first to fifth CH voltages, the developing, transferring, and detecting of the density of the segment are performed before the next segment is formed.

The image forming apparatus of the fifth embodiment includes a configuration in common with that of the first embodiment. Correction of the CH voltage is made by an engine controller 50. Thus, the fifth embodiment will also be described with reference to FIGS. 1-3, a description being made only of a portion different from the first embodiment.

Figure 33:
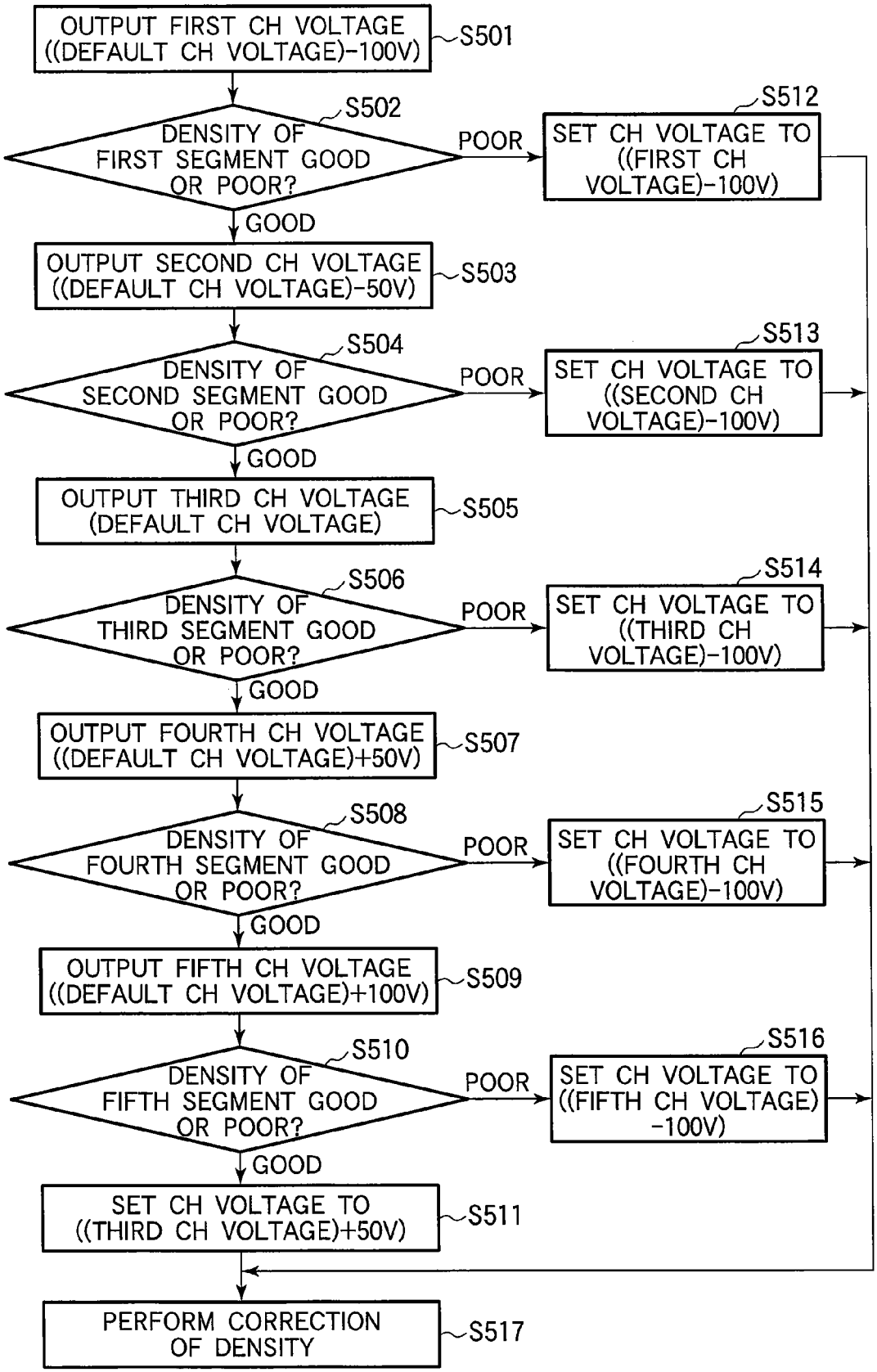
FIG. 33 is a flowchart illustrating the procedure for correcting the CH voltage performed by the engine controller.

FIG. 33 is a flowchart illustrating the procedure for correcting the CH voltage (i.e., setting of the CH voltage for a normal printing operation) performed by the engine controller 50. The correction is made sequentially for the respective image forming sections 16*a* to 16*d*. The procedure is common to the image forming sections 16*a* to 16*d*. Thus, the following description is common to the image forming sections 16*a* to 16*d*. The method for printing a density detection pattern having five segments is exactly the same as in the first embodiment. The method for determining whether the image forming apparatus is in good condition is also exactly the same as in the first embodiment. Therefore, the description of these methods is omitted.

S501: The image forming section 16 is ready to form a density detection pattern on the transport belt 9. A first CH voltage (Va), which is equal to "(default CH voltage)−100 V", is applied to the charging roller 25 (FIG. 2) for a predetermined period of time. The area of the photoconductive drum 21 charged by the first CH voltage is bought into contact with the thin layer of toner formed the developing roller 27, thereby becoming a first segment of the density detection pattern. As the photoconductive drum rotates, the first segment reaches a density sensor 12 which in turn detects the density of the first segment. Then, the density of the first segment is compared with a reference.

S512: If it is determined at S502 that the image forming apparatus is in poor condition, the CH voltage is set to "(first CH voltage)−100 V."

S517: Then, a variety of density corrections are made.

S503: If it is determined at S502 that the image forming apparatus is in good condition, a second CH voltage (Vb), which is equal to "(default CH voltage)−50 V", is applied to the charging roller 25 (FIG. 2) for a predetermined period of time. The area of the photoconductive drum 21 charged by the second CH voltage is bought into contact with the thin layer of toner formed the developing roller 27, thereby being developed into a second segment of the density detection pattern.

S504: As the transport belt 9 runs, the second segment reaches the density sensor 12 which in turn detects the density of the second segment. The density of the second segment is then compared with the reference.

S513: If it is determined at S504 that the image forming apparatus is in poor condition, the CH voltage is set to "(second CH voltage)−100 V."

S517: Then, a variety of density corrections are made.

S505: If it is determined at S504 that the image forming apparatus is in good condition, a third CH voltage (Vc), which is equal to "a reference voltage", is applied to the charging roller 25 (FIG. 2) for a predetermined period of time. The area of the photoconductive drum 21 charged by the first CH voltage is bought into contact with the thin layer of toner formed the developing roller 27, thereby being developed into a third segment of the density detection pattern.

S506: As the photoconductive drum rotates, the third segment reaches the density sensor 12 which in turn detects the density of the third segment. The density of the third segment is compared with the reference.

S514: If it is determined at S506 that the image forming apparatus is in poor condition, the CH voltage is set to "(third CH voltage)−100 V."

S517: Then, a variety of density corrections are made.

S507: If it is determined at S506 that the image forming apparatus is in good condition, a fourth CH voltage (Vd), which is equal to "(default CH voltage)+50 V", is applied to the charging roller 25 (FIG. 2) for a predetermined period of time. The area of the photoconductive drum 21 charged by the fourth CH voltage is bought into contact with the thin layer of toner formed the developing roller 27, thereby being developed into a fourth segment of the density detection pattern.

S508: As the transport belt runs, the fourth segment reaches the density sensor 12 which in turn detects the density of the fourth segment. The density of the fourth segment is then compared with the reference.

S515: If it is determined that the image forming apparatus is in poor condition, the CH voltage is set to "(fourth CH voltage)−100 V."

S517: Then, a variety of density corrections are made.

S509: If it is determined at S508 that the image forming apparatus is in good condition, a fifth CH voltage (Ve), which is equal to "default CH voltage+50 V", is applied to the charging roller 25 (FIG. 2) for a predetermined period of time. The area of the photoconductive drum 21 charged by the fifth CH voltage is bought into contact with the thin layer of toner formed the developing roller 27, thereby being developed into a fifth segment of the density detection pattern.

S510: As the transport belt runs, the fifth segment reaches the density sensor 12 which in turn detects the density of the fifth segment. The density of the fifth segment is compared with the reference.

S516: If it is determined that the image forming apparatus is in poor condition, the CH voltage is set to "(fifth CH voltage)−100 V."

S517: Then, a variety of density corrections are made.

S511: If it is determined at S510 that the image forming apparatus is in good condition, the CH voltage is set to "(third CH voltage)+50 V."

S517: Then, correction of density completes.

As described above, if it is determined that the image forming apparatus is in poor condition for the first segment, the program will proceed to the density correction operation (S517) immediately after the correction of the CH voltage is made at S512. It is to be noted that a check is made to determine whether the image forming apparatus is in poor condition before the next segment is formed. In other words, the five segments of a density detection patter are not printed at a time as opposed to the first embodiment. The fifth embodiment prevents unnecessary segments from being printed, thereby saving the amount of toner consumed.

Figure 34:
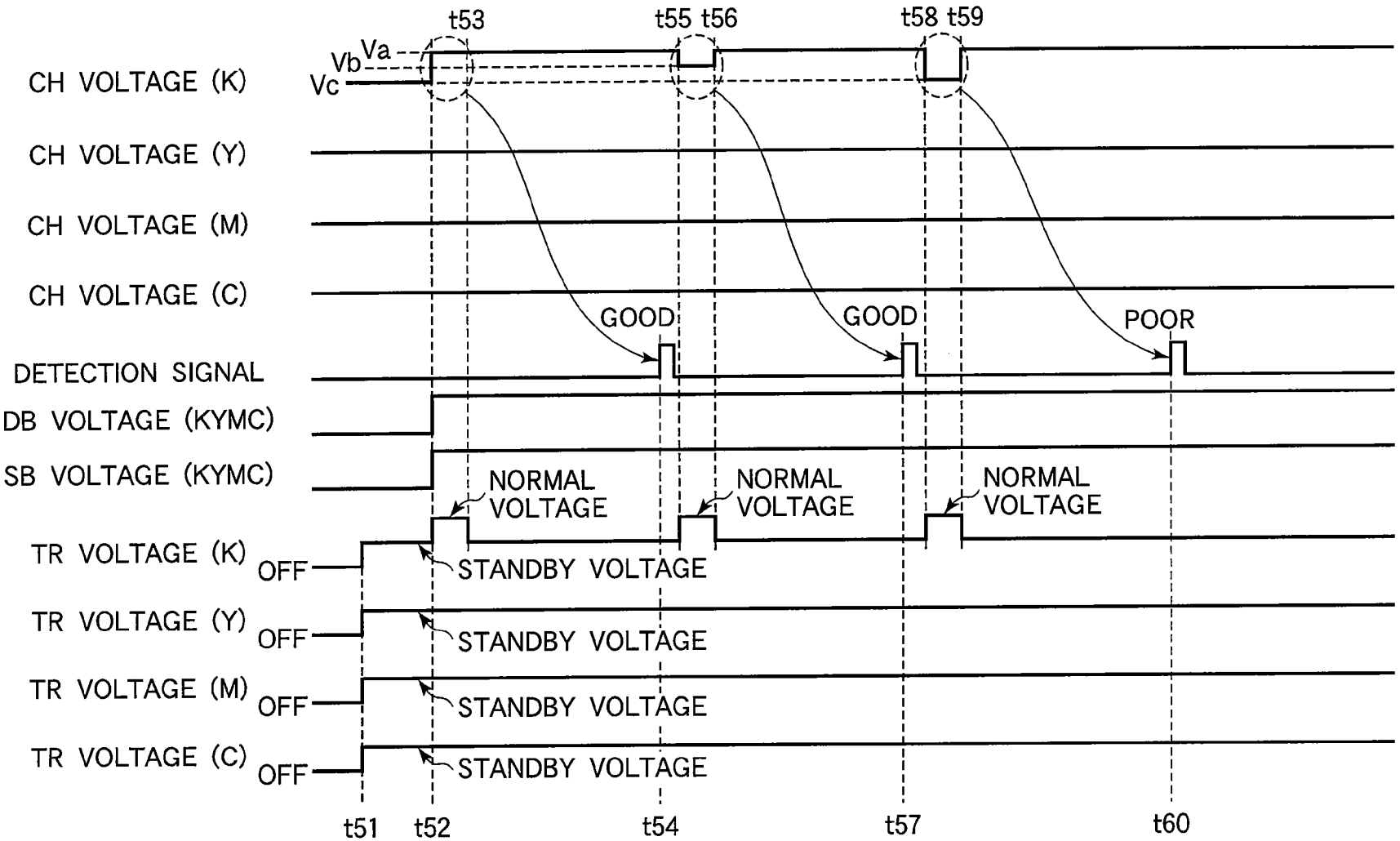
FIG. 34 is a timing chart illustrating the operation for correcting the CH voltage.

FIG. 34 is a timing chart illustrating the operation for correcting the CH voltage. The operation of the image forming apparatus 200 for detecting soiling due to toner-drum potential difference and soiling due to oppositely charged toner will be described with reference to FIGS. 1 to 3 and FIG. 34. It is assumed that the image forming apparatus is in poor condition at a third CH voltage.

In response to a command from the engine controller 50, a motor controller 51 drives a belt motor 56 and an ID motor 57 into rotation so that a transport belt 9 and a photoconductive drum 21 begin to rotate. A transfer roller 22, charging roller 25, developing roller 27, and toner supplying roller 28 begin to rotate via a rotation transmitting mechanism (not shown). A high-voltage controller 53 outputs high voltages shown in FIG. 34 in response to a control signal received from the engine controller 50.

The detection pattern for detecting the image density is formed on the transport belt 9 with the LED printhead 26 not energized. In other words, the light emitting diodes of the LED printhead 26 do not illuminate the surface of the photoconductive drum 21, and therefore FIG. 34 does not illustrate the control of the LED printhead.

At time t51, the voltages for the four colors (black, yellow, magenta, and cyan) are set to "OFF state voltage". At time t52, the high-voltage controller 53 outputs a DB voltage to the developing roller 27, a SB voltage to the toner supplying roller 28, and a CH voltage for black to the charging roller 25*a*. The CH voltage at this moment is a first CH voltage Va, a maximum value.

The density detection patterns of the respective colors are printed in sequence beginning from the black image forming section 16*a*.

The high-voltage controller 53 applies a TR voltage for black to the transfer roller 22*a* for a period of times t52-t53 to transfer a corresponding segment of a density detection pattern onto the transfer belt 9. After time t53, the CH voltage for black supplied to the charging roller 25*a* is maintained at the first CH voltage Va. At time t53, the TR voltage for black goes to the "OFF state voltage" and therefore no toner is transferred onto the transport belt 9. The first segment on the transport belt 9 reaches the density sensor 12 as the transport belt 9 runs, and the density of the first segment is detected at time t54. The detection output of the density sensor 12 is compared with the reference. If it is determined that the image forming apparatus is in good condition, a second CH voltage Vb is outputted for a period of times t55-t56 to form a second segment.

The areas on the photoconductive drum 21 charged by different CH voltages (i.e., segments of the pattern) reach a transfer point defined between the transfer roller 22 and the photoconductive drum 21 at timings displaced by a predetermined amount of time. For simplicity, the displacement in timing is not shown in FIG. 34.

The high-voltage controller 53 applies the TR voltage for black to the transfer roller 22*a* for a period of times t55-t56 to transfer a corresponding segment of a density detection pattern onto the transfer belt 9. After time t56, the CH voltage for black supplied to the charging roller 25*a* is maintained at the first CH voltage Va. At time t56, the TR voltage also goes off and therefore no toner is transferred onto the transport belt 9. The second segment on the transport belt 9 reaches the density sensor 12 as the transport belt 9 runs, and the density of the second segment is detected at time t57. The detection output of the density sensor 12 is compared with the reference. If it is determined that the image forming apparatus is in good condition, a third CH voltage Vb is outputted for a period of times t58-t59 to form a third segment.

The high-voltage controller 53 applies the TR voltage for black to the transfer roller 22*a* for a period of times t58-t59 to transfer a corresponding segment of a density detection pattern onto the transfer belt 9. After time t59, the CH voltage for black supplied to the charging roller 25*a* is maintained at the first CH voltage (Va). At time t59, the TR voltage for black also goes to the "OFF state voltage" and therefore no toner is transferred onto the transport belt 9. The third segment on the transport belt 9 reaches the density sensor 12 as the transport belt 9 runs, and the density of the third segment is detected at time t60. The detection output of the density sensor 12 is compared with the reference. If it is determined that the image forming apparatus is in poor condition, then, the CH voltage for the image forming section 16*a* is set to "(default CH voltage)−100V". Then, correction of the CH voltage for the image forming section 16*a* is terminated. If it is not determined that the image forming apparatus is in poor condition, the test is performed for a fourth CH voltage. If is not determined that the image forming apparatus is in poor condition, the test is performed for a fifth CH voltage. If it is not determined that the image forming apparatus is in poor condition, the CH voltage for the image forming section 16*a* is set to "(default CH voltage)−100V."

Likewise, the correction of the CH voltage is made sequentially for the respective image forming sections (Y, M, C) 16*b* to 16*d*. A segment is printed, developed, and transferred, then the density of the segment is detected, and finally a check is made to determine whether the image forming section is in good condition or in poor condition. It is to be noted that the check is made before the next segment is printed. Once the density of the segment exceeds that of the reference, the next segment will not printed, and correction of the CH voltage for the next image forming section is made.

The fifth embodiment has been described assuming that the image forming apparatus is found to be in poor condition at the third CH voltage. However, it is difficult to predict which image forming section at which of CH voltages is in poor condition. Thus, a segment is printed, developed, and transferred, then the density of the segment is detected, and finally a check is made to determine whether the image forming section is in good condition or in poor condition. It is to be noted that a following segment is not formed before the preceding segment has been checked to determine whether the image forming section is in good condition or in poor condition. This way of determining whether the image forming section is in good condition or in poor condition may also be applied to the second to fourth embodiments. Alternatively, for example, more than one segment may be printed at a time and a check may be made to determine whether the image forming section is in good condition or poor condition.

As described above, the fifth embodiment provides the same advantages as the first and second embodiments. It should be noted that only one segment of a density detection patter is printed at a time as opposed to the first embodiment where the five segments are printed at a time. In other words, the fifth embodiment prevents unnecessary segments from being printed, thereby saving the amount of toner consumed.

Sixth Embodiment

In the fifth embodiment, a segment is printed, developed, and transferred, then the density of the segment is detected, and finally a check is made to determine whether the image forming section is in good condition or in poor condition. The check is made before the next segment is printed. A sixth embodiment differs from the fifth embodiment in that the transport belt runs at a higher speed when the transport belt is running to the density sensor 12 after transferring a segment onto the transport belt than when the segment is being printed, developed, and transferred. Thus, the time required for correcting the CH voltage may be shorter.

The image forming apparatus of the sixth embodiment includes a configuration in common with that of the first embodiment. Correction of the CH voltage is made by an engine controller 50. Thus, the sixth embodiment will also be described primarily with reference to FIGS. 1-3, a description being made only of a portion different from the first embodiment.

Figure 35:
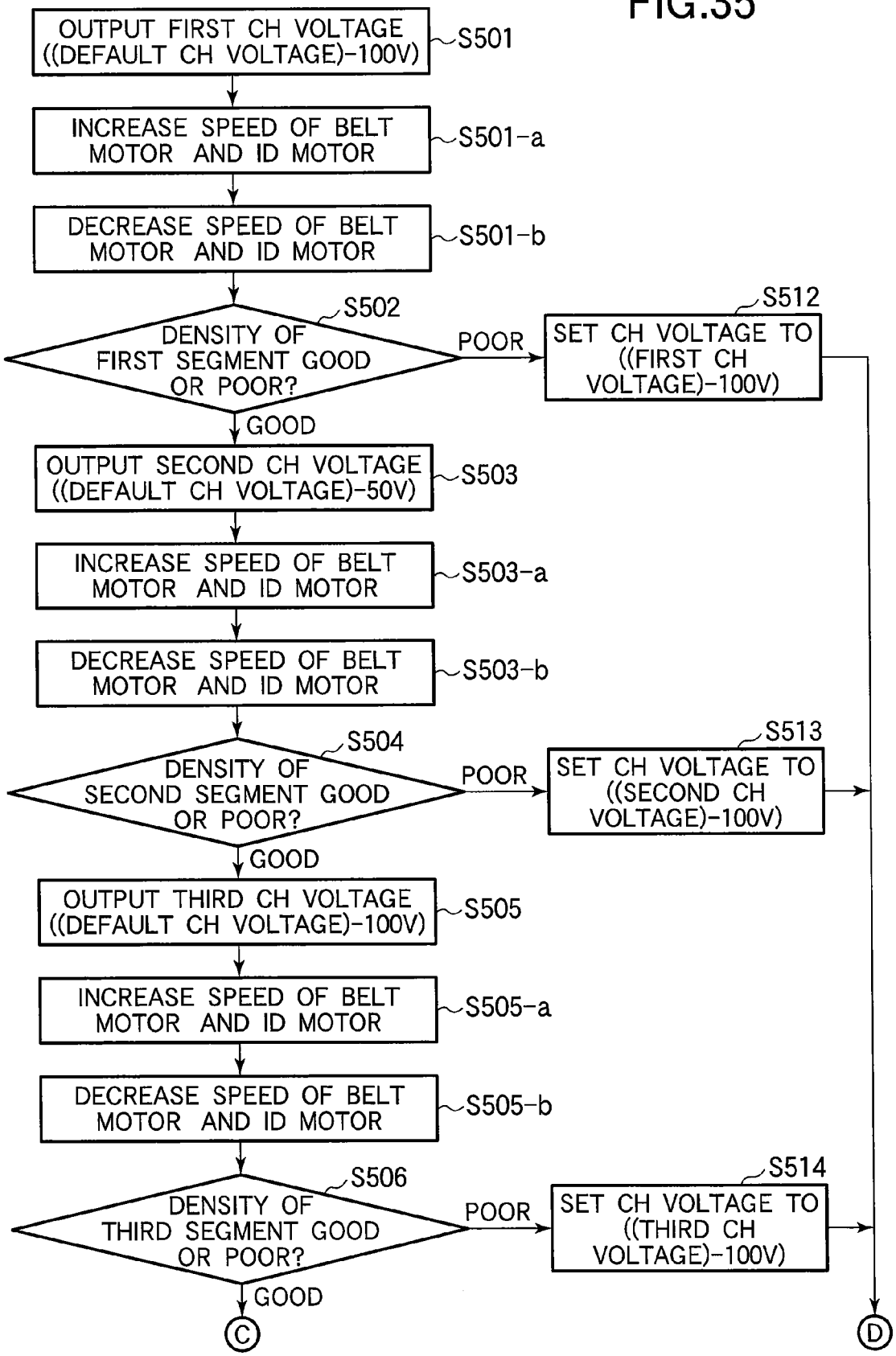
FIG. 35 is an initial portion of a flowchart illustrating the procedure for correcting the CH voltage performed by the engine controller.
Figure 36:
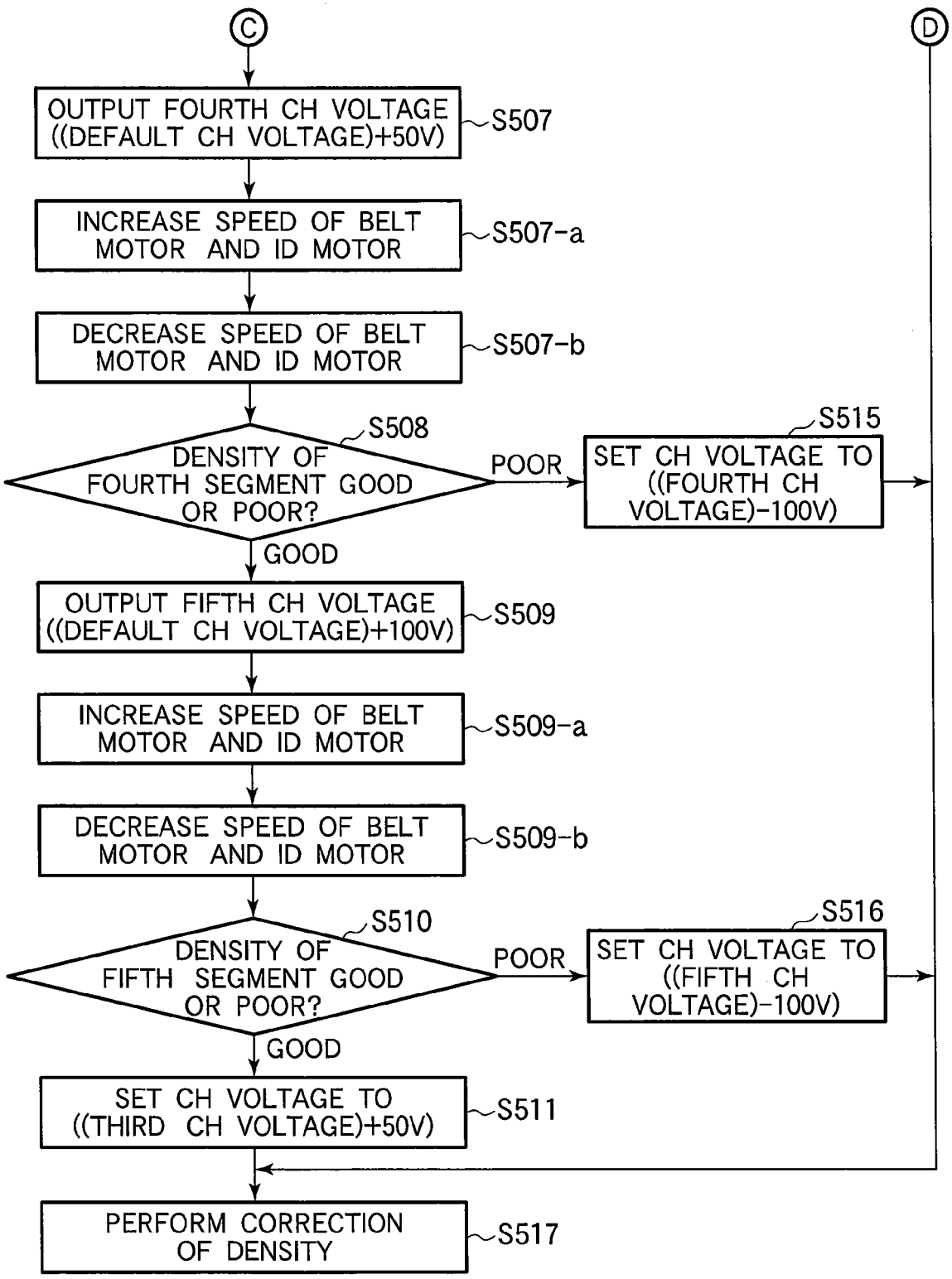
FIG. 36 is an additional portion of the flowchart.

FIG. 35 is an initial portion of a flowchart illustrating the procedure for correcting the CH voltage (i.e., setting of the CH voltage for a normal printing operation) performed by the engine controller 50. FIG. 36 is an additional portion of the flowchart. The correction value is determined sequentially for the respective image forming sections 16*a* to 16*d*. The same procedure is performed in the image-forming sections 16*a* to 16*d*. Thus, the following description is common to the image forming sections 16*a* to 16*d*. The sixth embodiment employs exactly the same method for printing a density detection pattern having five segments as the first embodiment. The sixth embodiment employs exactly the same method as the first embodiment for determining whether the image forming apparatus is in good condition. Therefore, the description of these methods is omitted.

Steps S501-S517 in FIGS. 35 and 36 are exactly the same as steps S501-S517 in FIG. 33 (fifth embodiment). Thus, the detailed description is omitted.

S501: The image forming section 16 is ready to form a density detection pattern on the transport belt 9. A first CH voltage (Va), which is equal to "(default CH voltage)−100 V", is applied to the charging roller 25 (FIG. 2) for a predetermined period of time. The area of the photoconductive drum 21 charged by the first CH voltage is bought into contact with the thin layer of toner formed the developing roller 27, thereby being developed into a first segment of the density detection pattern. As the transport belt 9 runs, the first segment reaches a density sensor 12 which in turn detects the density of the first segment. The density of the first segment is compared with a reference.

S501*a*: Immediately after transferring the first segment at step S501, the speed of a belt motor 56 and an ID motor 57 is accelerated, so that these motors rotate at higher speeds when the transport belt runs after transferring than when the first segment was printed, developed, and transferred onto the transport belt.

S501*b*: Before the first segment on the transport belt 9 reaches the density sensor 12, the speed of the belt motor 56 and the ID motor 57 is then decelerated to the speed at which the first segment was printed, developed, and transferred onto the transport belt.

S502: The density of the first segment is detected by the density sensor 12 and is compared with a reference.

Likewise, the speed of the belt motor 56 and the ID motor 57 is accelerated and then decelerated at steps S503*a* and S503*b* after S503, S505*a* and S505*b* after S505, S507*a* and S507*b* after S507, and S509*a* and S509*b* after S509, respectively, thereby shortening the time required for transporting the segments to the density sensor 12.

Figure 37:
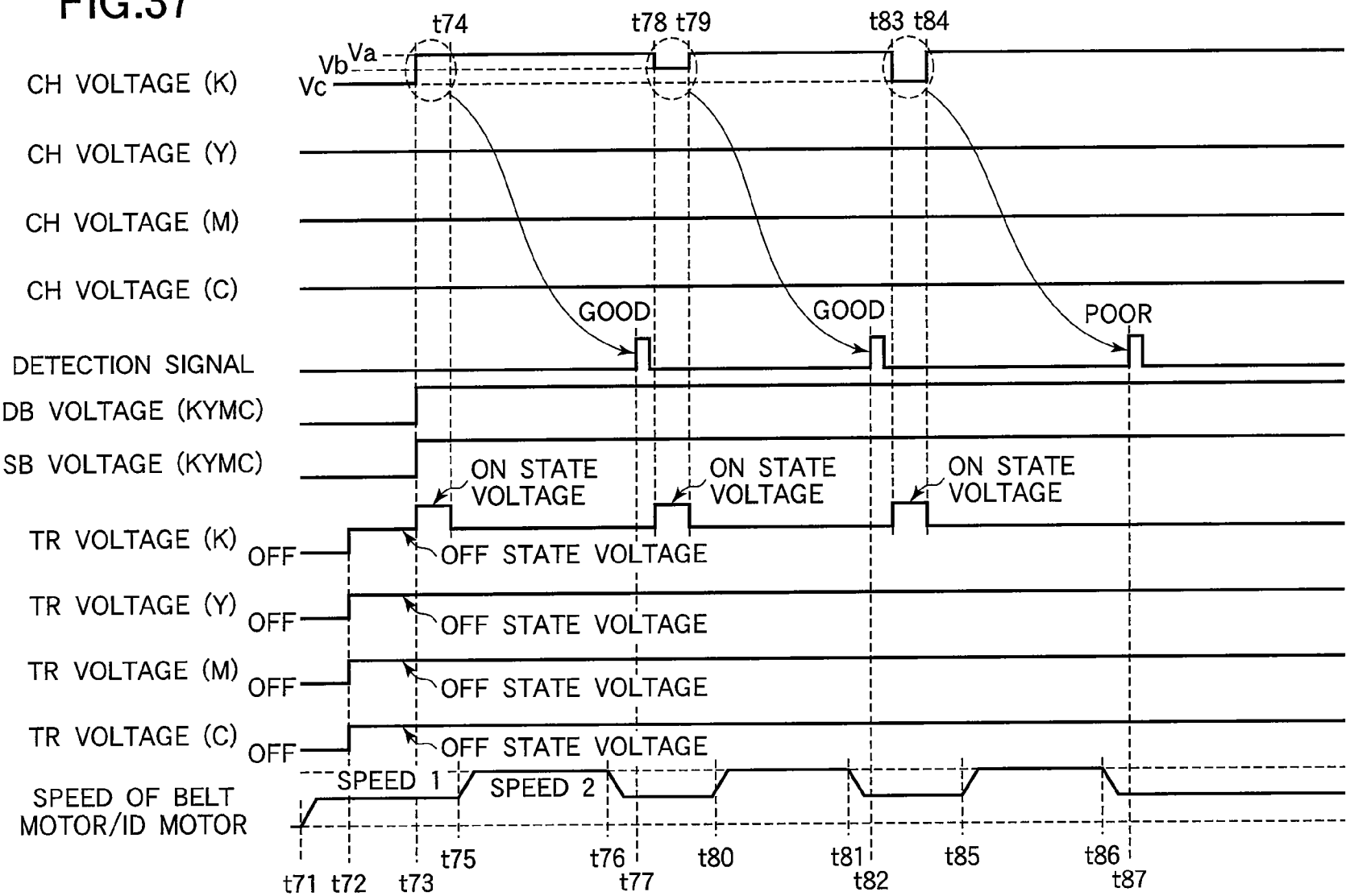
FIG. 37 is a timing chart illustrating the correction of the CH voltage performed in the image forming apparatus.

FIG. 37 is a timing chart illustrating the correction of the CH voltage performed in the image forming apparatus. The correction of the CH voltage will be described with reference to FIG. 37 and FIGS. 1-3.

In response to a command from the engine controller 50, a motor controller 51 drives the belt motor 56 and the ID motor 57 into rotation at time t71, so that the transport belt 9 and the photoconductive drum 21 begin to rotate. The rotation of the photoconductive drum 21 is transmitted via a rotation transmitting mechanism (not shown) to the transfer 22, charging roller 25, developing roller 27, and toner supplying roller 28. Upon receiving a control signal from the engine controller 50, the high-voltage controller 53 outputs high voltage sin FIG. 37.

A density detection pattern for detecting the image density is formed on the transport belt 9 with the LED printhead 26 not energized. In other words, the light emitting diodes of the LED printhead 26 do not illuminate the surface of the photoconductive drum 21, and therefore FIG. 37 does not illustrate the control of the LED printhead.

At time t72, the voltages for the four colors (black, yellow, magenta, and cyan) are set to the "OFF state voltage". Then, at time t73, the high-voltage controller 53 outputs a DB voltage to the developing roller 27, an SB voltage to the toner supplying roller 28, and a CH voltage for black to the charging roller 25*a*. The CH voltage at this moment is a first CH voltage Va, a maximum value.

The density detection patterns of the respective colors are printed in sequence beginning from the black image forming section 16*a*.

The high-voltage controller 53 applies a TR voltage for black to the transfer roller 22*a* for a period of times t73-t74 to transfer a corresponding segment of the density detection pattern onto the transfer belt 9. After time t74, the CH voltage for black supplied to the charging roller 25*a* is maintained at the first CH voltage Va at which soiling due to toner-drum potential difference is least likely to occur. At time t74, the TR voltage (K) goes to the "OFF state voltage" and therefore no toner is transferred onto the transport belt 9. The first segment on the transport belt 9 reaches the density sensor 12 as the transport belt 9 runs, and the density of the first segment is detected at time t77. The speed of the belt motor 56 and ID motor 57 are accelerated at time t75 and then decelerated at time t76, so that the transport belt 9 delivers the first segment at an increased speed to the density sensor 12.

The detection output of the density sensor 12 is compared with the reference. If it is determined that the image forming apparatus is in good condition, a second CH voltage Vb is outputted for a period of times t78-t79 to form a second segment.

The areas on the photoconductive drum 21 charged by different CH voltages (i.e., segments of the density detection pattern) reach a transfer point defined between the transfer roller 22 and the photoconductive drum 21 at timings displaced by a predetermined period of time. For simplicity, the displacement in timing is not shown in FIG. 34.

The high-voltage controller 53 applies the TR voltage to the transfer roller 22*a* for times t78-t79 to transfer a corresponding segment of the density detection pattern onto the transfer belt 9. After time t79, the CH voltage for black supplied to the charging roller 25*a* is maintained at the first CH voltage Va. At time t79, the TR voltage also goes to "OFF state voltage" and therefore no toner is transferred onto the transport belt 9. The second segment on the transport belt 9 reaches the density sensor 12 as the transport belt 9 runs, and the density of the second segment is detected at time t82. The detection output of the density sensor 12 is compared with the reference. The speed of the belt motor 56 and ID motor 57 are accelerated at time t80 and then decelerated at time t81, so that the transport belt 9 delivers the second segment at an increased speed to the density sensor 12.

The detection output of the density sensor 12 is compared with the reference. If it is determined that the image forming apparatus is in good condition, a third CH voltage (Vc) is outputted for a period of times t83-t84 to form a third segment.

The high-voltage controller 53 applies the TR voltage to the transfer roller 22*a* for a period of times t83-t84 to transfer a third segment of the density detection pattern onto the transfer belt 9. After time t84, the CH voltage for black supplied to the charging roller 25*a* is maintained at the first CH voltage (Va). At time t84, the TR voltage for black also goes to the "OFF state voltage" and therefore no toner is transferred onto the transport belt 9. The third segment on the transport belt 9 reaches the density sensor 12 as the transport belt 9 runs, and the density of the third segment is detected at time t87. The speeds of the belt motor 56 and ID motor 57 are accelerated at time t85 and then decelerated at time t86, so that the transport belt 9 delivers the third segment at an increased speed to the density sensor 12.

The detection output of the density sensor 12 is compared with the reference. If it is determined that the image forming apparatus is in poor condition, the correction of the CH voltage for the image forming section 16*a* is terminated.

Likewise, the CH voltage is corrected sequentially for the respective image forming sections (Y, M, C) 16*b* to 16*d*. A segment is printed, developed, and transferred, then the density of the segment is detected, and finally a check is made to determine whether the image forming section is in good condition or in poor condition the development. It is to be noted that the check is made before the next segment is printed. If the density of the segment exceeds the reference, the next segment is not printed, and correction of the CH voltage for the next image forming section is made.

The fifth embodiment has been described assuming that the image forming apparatus is found to be in poor condition at the third CH voltage. However, it is difficult to predict which image forming section at which of CH voltages is in poor condition. Thus, a segment is printed, developed, and transferred, then the density of the segment is detected, and finally a check is made to determine whether the image forming section is in good condition or in poor condition. The procedure is repeated for each of the five segments of the density detection pattern before the next segment is formed. This way of determining whether the image forming section is in good condition or in poor condition may also be applied to the second to fourth embodiments.

As described above, the sixth embodiment provides the same advantages as the fifth embodiment. In the sixth embodiment, the transport belt runs at an increased speed from when a segment of the density detection pattern is transferred onto the transport belt 9 until the segment reaches the density sensor 12. Thus, the time required for correcting the CH voltage may be shortened. While the present invention has been described in terms of a color printer, the invention is not limited to this. For example, the invention may also be applicable to facsimile machines, copying machines, multifunction peripherals (MFP).

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus including at least one image forming section, wherein the image forming section includes an image bearing body, a charging unit that charges an area on a surface of the image bearing body, and a developing unit that supplies a developer material to the charged area to form a developer image on the image bearing body, the image forming apparatus comprising:

a transporting unit onto which the developer image is transferred from the image bearing body;

a detector that detects a density of the developer image on said transporting unit; and a voltage controller that provides a test charging voltage for forming the developer image on the image bearing body and a normal charging voltage for performing a normal printing operation, to the charging unit;

wherein the voltage controller is configured to perform a charging voltage correcting operation in which said voltage controller provides the test charging voltage to the charging unit, and then determine the normal charging voltage based on the density of the developer image detected by said detector;

wherein the test charging voltage is variable in absolute voltage value stepwise from highest to lowest, and the developer image varies in density in accordance with a corresponding voltage value of the test charging voltage;

wherein said voltage controller is configured to set the normal charging voltage based on a voltage value of the test charging voltage that causes the density to be greater than the reference value when the density detected by said detector is greater than a reference value;

wherein said detector is configured to detect the density of the developer image formed by the corresponding voltage value of the test charging voltage before a next developer image is formed; and wherein the voltage controller is configured to terminate providing the test charging voltage to the charging unit when the density detected by said detector is greater than the reference value.

2. The image forming apparatus according to claim 1, wherein the transporting unit is configured to transport the developer image at a higher speed after the developer image has been transferred onto the transporting unit, than before the developer image has been transferred onto the transporting unit.

3. The image forming apparatus according to claim 1, further comprising an exposing unit configured to form an electrostatic latent image on the image bearing body in a normal printing operation;

wherein the developer image is formed when said exposing unit is not energized.

4. An image forming apparatus including at least one image forming section, wherein the image forming section includes an image bearing body, a charging unit that charges an area on a surface of the image bearing body, and a developing unit that supplies a developer material to the charged area to form a developer image on the image bearing body, the image forming apparatus comprising:

a transporting unit onto which the developer image is transferred from the image bearing body;

a detector that detects a density of the developer image on said transporting unit; and a voltage controller that provides a test charging voltage for forming the developer image on the image bearing body and a normal charging voltage for performing a normal printing operation, to the charging unit;

wherein the voltage controller is configured to perform a charging voltage correcting operation in which said voltage controller provides the test charging voltage to the charging unit, and then determine the normal charging voltage based on the density of the developer image detected by said detector;

wherein the test charging voltage is variable in absolute voltage value stepwise from highest to lowest, and the developer image varies in density in accordance with a corresponding voltage value of the test charging voltage;

wherein said voltage controller is configured to set the normal charging voltage based on a voltage value of the test charging voltage that causes the density to be smaller than the reference value when the density detected by said detector is smaller than a reference value;

wherein said detector is configured to detect the density of the developer image formed by the corresponding voltage value of the test charging voltage before a next developer image is formed; and wherein the voltage controller is configured to terminate providing the test charging voltage to the charging unit when the density detected by said detector is smaller than the reference value.

5. The image forming apparatus according to claim 4, wherein the transporting unit is configured to transport the developer image at a higher speed after the developer image has been transferred onto the transporting unit, than before the developer image has been transferred onto the transporting unit.

6. An image forming apparatus including at least one image forming section, wherein the image forming section includes an image bearing body, a charging unit that charges an area on a surface of the image bearing body, and a developing unit that supplies a developer material to the charged area to form a developer image on the image bearing body, the image forming apparatus comprising:

a transporting unit onto which the developer image is transferred from the image bearing body;

a detector that detects a density of the developer image on said transporting unit; and a voltage controller that provides to the charging unit a test charging voltage for forming the developer image on the image bearing body and a normal charging voltage for performing a normal printing operation, wherein the voltage controller is configured to perform a charging voltage correcting operation in which said voltage controller provides the test charging voltage to the charging unit, and then determine the normal charging voltage based on the density of the developer image detected by said detector;

a remaining lifetime counter that counts a remaining lifetime of the image forming section; and a remaining lifetime memory that stores a count of said remaining lifetime counter;

wherein said voltage controller is configured to set the number of voltage values of the test charging voltage in accordance with the count of said remaining lifetime counter.

7. An image forming apparatus including at least one image forming section, wherein the image forming section includes an image bearing body, a charging unit that charges an area on a surface of the image bearing body, and a developing unit that supplies a developer material to the charged area to form a developer image on the image bearing body, the image forming apparatus comprising:

a transporting unit onto which the developer image is transferred from the image bearing body;

a detector that detects a density of the developer image on said transporting unit;

a voltage controller that provides to the charging unit a test charging voltage for forming the developer image on the image bearing body and a normal charging voltage for performing a normal printing operation, wherein the voltage controller is configured to perform a charging voltage correcting operation in which said voltage controller provides the test charging voltage to the charging unit, and then determines the normal charging voltage based on the density of the developer image detected by said detector; and a print quality memory that stores a current level of print quality based on the density detected by said detector;

wherein the voltage controller is configured to generate the test charging voltage either in a first mode where a first number of voltage values of the test charging voltage is used or in a second mode where a second number of voltage values of the test charging voltage is used, depending on the current level of print quality stored in said print quality memory.

8. The image forming apparatus according to claim 7, wherein the image forming apparatus is configured to read the current level of print quality from the print quality memory and provide to a user the current level of print quality by at least one of displaying the current level of print quality on a display device and printing out the current level of print quality.

9. An image forming apparatus including at least one image forming section, wherein the image forming section includes an image bearing body, a charging unit that charges an area on a surface of the image bearing body, a developing unit that supplies a developer material to the charged area to form a developer image on the image bearing body, and a developer-supplying unit that supplies the developer material to the developing unit, the image forming apparatus comprising:

a transporting unit onto which the developer image is transferred from the image bearing body;

a detector that detects a density of the developer image on said transporting unit;

a voltage controller that provides a test charging voltage for forming the developer image on the image bearing body to the charging unit and a developer-supplying voltage to the developer-supplying unit, wherein said voltage controller is configured to perform a developer-supplying voltage correcting operation in which said voltage controller provides the test charging voltage to the charging unit, and then determine the developer-supplying voltage based on the density detected by said detector;

a remaining lifetime counter that counts a remaining lifetime of the image forming section; and a remaining lifetime memory that stores a count of said remaining lifetime counter;

wherein said voltage controller is configured to set a number of voltage values of the test charging voltage in accordance with the count of said remaining lifetime counter.

10. An image forming apparatus including at least one image forming section, wherein the image forming section includes an image bearing body, a charging unit that charges an area on a surface of the image bearing body, a developing unit that supplies a developer material to the charged area to form a developer image on the image bearing body, and a developer-supplying unit that supplies the developer material to the developing unit, the image forming apparatus comprising:

a transporting unit onto which the developer image is transferred from the image bearing body;

a detector that detects a density of the developer image on said transporting unit;

a voltage controller that provides a test charging voltage for forming the developer image on the image bearing body to the charging unit and a developer-supplying voltage to the developer-supplying unit, wherein said voltage controller is configured to perform a developer-supplying voltage correcting operation in which said voltage controller provides the test charging voltage to the charging unit, and then determine the developer-supplying voltage based on the density detected by said detector; and a print quality memory that stores a current level of print quality based on the density detected by said detector;

wherein said voltage controller is configured to generate the test charging voltage either in a first mode where a first number of voltage values of the test charging voltage is used or in a second mode where a second number of voltage values of the test charging voltage is used, depending on the current level of print quality stored in said print quality memory.

11. The image forming apparatus according to claim 1, wherein the voltage controller is configured to provide the test charging voltage which includes a plurality of voltage values that include the normal charging voltage, and wherein said voltage controller is configured to provide to the charging unit a charging voltage that is smaller in absolute value than the normal charging voltage and that is selected from the plurality of voltage values when the densities of the developer image detected for the plurality of voltage values is equal to or greater than the reference value.

12. The image forming apparatus according to claim 11, wherein at least one of the plurality of voltage values is not less in absolute value than the normal charging voltage, and at least one of the plurality of voltage values is smaller in absolute value than the normal charging voltage.

13. The image forming apparatus according to claim 12, wherein a corresponding charging voltage is increased in absolute value when one of the plurality of voltages results in a density of the developer image greater than the reference value.

14. The image forming apparatus according to claim 1, wherein the reference value is a value above which soiling of the image bearing body occurs.

15. An image forming apparatus including at least one image forming section incorporating an image bearing body, the image forming apparatus comprising:

a contact member in contact with the image bearing body, said contact member causing a potential of a surface of the image bearing body to change;

a voltage controller that applies a voltage to said contact member;

a developer material that varies in adhesion to the image bearing body according to the voltage applied by said voltage controller to said contact member;

a transporting section onto which the developer material is transferred; and a detecting section that detects a density of the developer material on said transporting section;

wherein said voltage controller is configured to control a test charging voltage to vary in absolute voltage value stepwise to a voltage value at which the density of the developer material on the transporting section changes from a value smaller than a reference value to another value greater than the reference value, wherein the voltage controller is configured to provide the voltage according to the absolute voltage value to said contact member during a printing operation;

wherein the test charging voltage includes a plurality of voltage values that include a normal charging voltage for performing a normal printing operation, and said voltage controller is configured to provide a charging voltage to the contact member, the charging voltage being smaller in absolute voltage value than the normal charging voltage and being selected from the plurality of voltage values when none of the densities of the developer image detected for the plurality of voltage values is equal to or greater than the reference value.

16. The image forming apparatus according to claim 15, wherein at least one of the plurality of voltage values is larger in absolute value than the normal charging voltage, and at least one of the plurality of voltage values is smaller in absolute value than the normal charging voltage.

17. The image forming apparatus according to claim 16, wherein, a corresponding charging voltage applied to said contact member is increased in absolute value when any one of the plurality of voltages results in a density of the developer image equal to or greater than the reference.

18. The image forming apparatus according to claim 15, wherein the reference value is a value above which soiling of the image bearing body occurs.

* * * * *